US005173395A

United States Patent [19]

Asami

[11] Patent Number: 5,173,395

[45] Date of Patent: * Dec. 22, 1992

[54] METHOD FOR FORMING COLOR IMAGE

[75] Inventor: Masahiro Asami, Kanagawa, Japan

[73] Assignee: Fuji Photo Film Co., Ltd., Kanagawa, Japan

[ * ] Notice: The portion of the term of this patent subsequent to Mar. 19, 2008 has been disclaimed.

[21] Appl. No.: 417,618

[22] Filed: Oct. 5, 1989

[30] Foreign Application Priority Data

Oct. 7, 1988 [JP] Japan ..... 63-253377

[51] Int. Cl.[5] ..... G03C 7/26; G03C 7/30

[52] U.S. Cl. ..... 430/376; 430/377; 430/380; 430/382; 430/383; 430/467; 430/507; 430/522; 430/963

[58] Field of Search ..... 430/376, 377, 380, 382, 430/383, 467, 507, 522, 963

[56] References Cited

U.S. PATENT DOCUMENTS

| | | | |
|---|---|---|---|
| 4,830,955 | 5/1989 | Kajiwara et al. | 430/505 |
| 4,851,326 | 7/1989 | Ishikawa et al. | 430/380 |
| 4,853,321 | 8/1989 | Momoki et al. | 430/380 |
| 4,880,728 | 11/1989 | Ishikawa et al. | 430/380 |
| 5,001,042 | 3/1991 | Hasebe | 430/382 |
| 5,093,226 | 3/1992 | Ohshima | 430/377 |

FOREIGN PATENT DOCUMENTS

| | | |
|---|---|---|
| 0286331 | 8/1988 | European Pat. Off. . |
| 2275246 | 11/1987 | Japan . |

*Primary Examiner*—Marion E. McCamish
*Assistant Examiner*—Janis L. Dote
*Attorney, Agent, or Firm*—Sughrue, Mion, Zinn, Macpeak & Seas

[57] ABSTRACT

A method for forming a color image which comprises developing an imagewise exposed silver halide color photographic material with a color developer containing at least one aromatic primary amine developing agent, wherein said silver halide color photographic material comprises a reflective support, whose transmission density in the red region ranges from 0.2 to 0.9, having thereon at least one light-sensitive emulsion layer containing at least one coupler capable of forming a dye on coupling with an oxidation product of the developing agent and silver chlorobromide grains comprising at least 80 mol % of silver chloride and containing substantially no silver iodide, said support having further provided thereon a dye represented by formula (A):

(A)

wherein $R_{101}$ and $R_{102}$ each represents $-OR_{105}$, $-COOR_{105}$, $-COR_{105}$, $-CN$ or $-R_{107}$, wherein $R_{105}$ and $R_{106}$ each represents a hydrogen atom, a substituted or unsubstituted alkyl group or a substituted or unsubstituted aryl group, and $R_{107}$ represents an alkyl group or an alkyl group substituted with a halogen atom, etc.; $R_{103}$ and $R_{104}$ each represents an alkyl, aralkyl or aryl group substituted with at least one of a sulfo group and a carboxyl group; and $L_{101}$ represents a substituted or unsubstituted methine group, and the color developer contains from $3.5\times10^{-2}$ to $1.5\times10^{-1}$ mol/l of chloride ion and from $3.0\times10^{-5}$ to $1.0\times10^{-3}$ mol/l of bromide ion.

12 Claims, No Drawings

METHOD FOR FORMING COLOR IMAGE

FIELD OF THE INVENTION

This invention relates to a method of color image formation with a silver halide color photographic material. More particularly, it relates to a method for forming a color image which is suited for rapid and stable production of color prints having high sharpness quality.

BACKGROUND OF THE INVENTION

In photographic processing of color photographic materials, demands for higher efficiency and higher productivity have recently been increasing. The tendency is particularly pronounced in the field of color print production, and it has been highly desirable to shorten the processing time in order to cope with the request for rapid delivery of finished prints.

As is well known, processing for obtaining color prints comprises light exposure and color development. Use of a highly sensitive light-sensitive material leads to a reduction in exposure time. On the other hand, reduction of color development time essentially requires the combination of a light-sensitive material which can be rapidly developed and a processing solution or a processing method.

Known techniques proposed to accomplish the above-described object include use of a color photographic material containing a silver chloride emulsion in place of a silver chlorobromide emulsion having a high bromide content that has been widely employed in the conventional light-sensitive materials for color prints (hereinafter referred to as a color paper). For example, International Publication WO 87-04534 discloses a method of rapidly developing a color photographic material containing a high silver chloride emulsion with a color developer containing substantially no sulfite ion and benzyl alcohol.

Further, JP-A-61-70552 proposes a method for reducing the rate of developer replenishment, in which a high silver chloride color photographic material is development-processed while replenishing a development bath at such a rate that does not cause overflow (the term "JP-A" as used herein means an "unexamined published Japanese patent application"). JP-A-63-106655 discloses a method for assuring processing stability, in which a high silver chloride color photographic material is development-processed with a color developer containing a hydroxylamine compound and a chloride at or above a given concentration.

From the viewpoint of color print production in photofinishing laboratories (the so-called color laboratories), an increase in productivity as high as is possible within a limited area is required. Today for increased efficiency, saving of space for storing the color paper or reduction in size of a printer or a processer has also been strongly demanded. In this connection, a reduction in thickness of the color paper would result in an increased volume of color paper which can be wound around a roll, thereby attaining efficiency, for example, through reduction in magazine size.

However, color papers prepared using a thin support with the above purpose in mind have proved to have, unexpectedly, defects in performance. That is, a deterioration of image sharpness occurs in color prints obtained from the thus prepared thin color papers and this is a great problem in practical use.

On the other hand, in the field of advertisement, a print obtained from a negative which is observed by transmitted light has been widely put into practical use as a display. There is now on the market a light-sensitive material which can be observed using either transmitted light or reflected light and has enjoyed an increasing demand because it serves as a display without the necessity for lighting. Light-sensitive materials of this type generally comprise a semi-transparent support having provided thereon light-sensitive emulsion layers. However, the same problem of reduced sharpness is encountered with these materials.

This problem has been studied, considering factors common to the above-described two types of light-sensitive materials. As a result, it has been found that the reduction in transmission density (especially in the red region) of a support causes this deterioration in sharpness.

It is known to incorporate a dye for preventing irradiation or halation into a light-sensitive material to thereby improve sharpness. Dyes which can be introduced into the above-described reflection type light-sensitive materials for this purpose must not adversely influence the performance properties of the light-sensitive materials, such as sensitivity, gradation and storability of the products and be capable of being rapidly washed away or rendered colorless upon development processing so as not to remain to cause staining of the white background.

Examples of dyes known to meet these requirements include oxonol dyes described in U.S. Pat. Nos. 3,247,127, 3,469,985, and 4,078,933, anthraquinone dyes described in U.S. Pat. No. 2,865,752, and cyanine dyes described in U.S. Pat. Nos. 2,843,486 and 3,294,539.

It has been found on testing, however, that incorporation of these dyes into the above-described high silver chloride light-sensitive material, which can be subjected to rapid processing, in order to compensate for the deterioration of sharpness due to reduction of transmission density of a reflective support gives rise to serious problems That is, when these known dyes are combined with a silver halide emulsion having a high silver chloride content, (1) most of them have turned out to cause considerable desensitization upon exposure in an atmosphere of high humidity; (2) even those dyes that do not cause desensitization at high humidity have turned out to cause acceleration of development in the toe of the characteristic curve to impair the linearity of photographic response thereby failing to reproduce favorable gradation; and (3) even these dyes that do not cause desensitization at high humidity have turned out to increase fog during long-term continuous processing.

Accordingly, development of techniques overcoming these problems has been an important subject for improving productivity and efficiency in color laboratories

SUMMARY OF THE INVENTION

One object of this invention is to provide a method for forming a color image by using a silver halide color photographic material which has high sensitivity, can be rapidly developed, and exhibits excellent sharpness even with a support having a low transmission density, which method makes it feasible to rapidly and stably produce high quality color prints.

Another object of this invention is to provide a method for forming a color image, which allows a size reduction of a light-sensitive material and improvement in the productivity of color prints.

A further object of this invention is to provide a method for forming a color image which can be applied to rapid processing of a light-sensitive material for both transmission and reflection display to obtain an image having excellent sharpness.

It has now been found that the above objects of this invention are accomplished by a method for forming a color image which comprises developing an imagewise exposed silver halide color photographic material with a color developer containing at least one aromatic primary amine developing agent, wherein the silver halide color photographic material comprises a reflective support whose transmission density in the red region ranges from 0.2 to 0.9 and has thereon at least one light-sensitive emulsion layer containing at least one coupler capable of forming a dye on coupling with an oxidation product of the developing agent and silver chlorobromide grains comprising at least 80 mol % of silver chloride and containing substantially no silver iodide, with the support having further thereon a dye represented by formula (A):

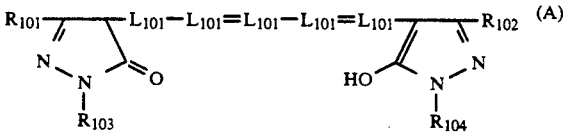

(A)

wherein $R_{101}$ and $R_{102}$ each represents $-OR_{105}$, $-COOR_{105}$, $$-\underset{\underset{R_{106}}{|}}{CON}-R_{105},$$

$-COR_{105}$, $-CN$ or $-R_{107}$, wherein $R_{105}$ and $R_{106}$ each represents a hydrogen atom, a substituted or unsubstituted alkyl group (preferably having 1 to 6 carbon atoms) or a substituted or unsubstituted aryl group (preferably having 6 to 10 carbon atoms), and $R_{107}$ represents an alkyl group or an alkyl group substituted with a halogen atom, a carboxyl group, a sulfo group and a hydroxy group, etc. (preferably having 1 to 6 carbon atoms); $R_{103}$ and $R_{104}$ each represents an alkyl (preferably having 1 to 6 carbon atoms) aralkyl (preferably having 7 to 12 carbon atoms) or aryl (preferably having 6 to 10 carbon atoms) group substituted with at least one of a sulfo group and a carboxyl group; and $L_{101}$ represents a substituted or unsubstituted methine group, and the color developer contains from $3.5\times10^{-2}$ to $1.5\times10^{-1}$ mol/l of chloride ion and form $3.0\times10^{-5}$ to $1.0\times10^{-3}$ mol/l of bromide ion.

DETAILED DESCRIPTION OF THE INVENTION

The silver halide emulsion which can be used in this invention contains silver chlorobromide grains having a silver chloride content of at least 80 mol % and containing substantially no silver iodide. The phrase "substantially no silver iodide" means that the silver iodide content is not more than 1.0 mol %, preferably not more than 0.2 mol %. If the silver chloride content is less than 80 mol % or if the silver iodide content is more than 1.0 mol %, the rate of development is too low for rapid processing to be employed. Accordingly, the higher the silver chloride content, the better. Namely, the silver chloride content is preferably 90 mol % or more, more preferably 95 mol % or more. A further increased silver chloride content is useful to advantage for decreasing the rate of developer replenishment. In this case, an emulsion comprising almost pure silver chloride having a silver chloride content of from 98 to 99.9 mol % is preferably used. It should be noted, however, that use of a completely pure silver chloride emulsion sometimes results in disadvantages in obtaining high sensitivity or preventing pressure marks.

The remainder of the silver halide grains substantially comprises silver bromide. Silver bromide may be uniformly distributed throughout the individual grains (a homogeneous solid solution of silver chlorobromide forming a single grain) or may form a phase having a different silver bromide content. In the latter case, the grains may be the so-called core/shell type grains in which the inner core and a single or plural layers surrounding the core have different halogen compositions, or grains having local phases differing in silver bromide content (preferably having higher silver bromide contents) discontinuously formed in the inside or on the surface thereof These local phases of higher silver bromide content may be present in the inside of the grains or on the surface of the grains, i.e., on the edges, corners or planes of the grains. One preferred embodiment of such heterogeneous grains are those having local phases on the corners of the grains produced by epitaxy.

The mean grain size (number average of the grain size expressed in terms of a diameter of a circle having an equivalent area as the projected area of a grain) of the silver halide grains preferably ranges form 0.1 to 2 μm.

The silver halide emulsion is preferably a so-called monodispersion having a coefficient of variation of grain size of not more than 20%, more preferably not more than 15%, the coefficient of variation being a quotient obtained by dividing the standard deviation of the grain size by the mean grain size. For the purpose of attaining broad latitude to exposure, it is preferable to use two or more monodispersed emulsions in the same layer or to coat two or more monodispersed emulsions in different layers.

The silver halide grains in the photographic emulsions may have a regular crystal form, such as a cubic form, a tetradecahedral form, and an octahedral form; or an irregular crystal form, such as a spherical form and a plate (tabular) form; or a composite form thereof. The emulsion may be composed of grains of various crystal forms. In the present invention, emulsions which are preferred are those containing not less than 50%, more preferably not less than 70%, most preferably not less than 90%, of regular crystals.

In addition, emulsions containing tabular grains having an average aspect ratio (circle-equivalent diameter/thickness ratio) of 5 or more, preferably 8 or more, in a proportion exceeding 50% of the projected area of the total grain can also be used advantageously.

The silver chlorobromide emulsions to be used in the present invention can be prepared by known techniques as described in P. Glafkides, *Chemie et Phisique Photographique,* Paul Montel (1967), G. F. Duffin, *Photographic Emulsion Chemistry,* Focal Press (1966), and V. L. Zelikman et al., *Making and Coating Photographic Emulsion,* Focal Press (1964). In more detail, any of the acid process, the neutral process, the ammonia process, and the like can be used. The reaction between a soluble silver salt and a soluble halogen salt can be carried out by any of a single jet process, a double jet process, and a combination thereof. A so-called reverse mixing process in which grains are formed in the presence of excess silver ions can also be utilized. A so-called controlled double jet process, in which the pAg value of the liquid phase where silver halide grains are formed is maintained constant, can also be used. Using the controlled double jet process, a silver halide emulsion having a regular crystal form and a nearly uniform grain size distribution can be obtained.

During the grain formation or physical ripening subsequent thereto, various polyvalent metal ions can be introduced into the system as impurities. Polyvalent metal compounds which can be used include salts of cadmium, zinc, lead, copper or thallium; and salts or complexes of the Group VIII metals, e.g., iron, ruthenium, rhodium, palladium, osmium, iridium, and platinum. The compounds of the Group VIII metals are particularly preferred. The amounts of these compounds to be added are preferably from $10^{-9}$ to $10^{-2}$ mol per mol of silver halide, although the amount can vary widely depending on the purpose of addition.

The silver halide emulsions to be used in this invention are generally subjected to chemical sensitization and spectral sensitization.

Chemical sensitization can be effected by sulfur sensitization using instable sulfur compounds, noble metal sensitization typically including gold sensitization, reduction sensitization, or a combination thereof. Compounds to be used in chemical sensitization preferably include those described in JP-A-62-215272, p. 18, right lower column to p. 22, right upper column.

For the purpose of preventing fog during preparation, storage or photographic processing of light-sensitive materials or stabilizing photographic performance properties, the photographic emulsions to be used in the present invention can contain various kinds of compounds, such as azoles, e.g., benzothiazolium salts, nitroimidazoles, nitrobenzimidazoles, chlorobenzimidazoles, bromobenzimidiazoles, mercaptothiazoles, mercaptobenzothiazoles, mercaptobenzimidazoles, mercaptothiadiazoles , aminotriazoles, benzotriazoles, nitrobenzotriazoles, mercaptotetrazoles (especially 1-phenyl-5-mercaptotetrazole), mercaptopyrimidines, and mercaptotriazines; thioketo compounds, e.g., oxazolinethione; azaindenes, e.g., triazaindenes, tetraazaindenes [especially 4-hydroxy-substituted (1,3,3a,7)tetraazaindene], and pentaazaindenes; benzenethiosulfonic acid, benzenesulfinic acid, benzenesulfonic acid amide; and any other compounds known as antifoggants or stabilizers.

In particular, it is preferable to add to the emulsions mercaptoazoles represented by formulae (I), (II) or (III):

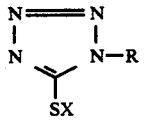

(I)

wherein R represents an alkyl group (preferably having 1 to 5 carbon atoms), an alkenyl group (preferably having 10 or less carbon atoms), or an aryl group (preferably having 10 or less carbon atoms); and X represents a hydrogen atom, an alkali metal atom, an ammonium group, or a precursor thereof.

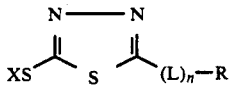

(II)

wherein X is as defined above; L represents a divalent linking group; R represents a hydrogen atom, an alkyl group (preferably having 1 to 5 carbon atoms), an alkenyl group (preferably having 10 or less carbon atoms), or an aryl group (preferably having 10 or less carbon atoms); and n represents 0 or 1.

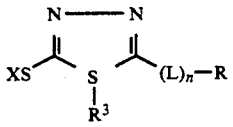

(III)

wherein R and X are as defined in formula (I); L and n are as defined in formula (II); and $R_3$ has the same meaning as R and may be the same as or different from R.

In formulae (I), (II), and (III), the alkali metal atom as represented by X includes a sodium atom and a potassium atom; the ammonium group includes a tetramethylammonium group and a trimethylbenzylammonium group; and a precursor means a group capable of being converted to a hydrogen atom or an alkali metal atom under alkaline conditions, including an acetyl group, a cyanoethyl group, and a methanesulfonylethyl group.

In formulae (I), (II), and (III), the alkyl and alkenyl groups as represented by R may be substituted or unsubstituted and include alicyclic groups. Substituents for the substituted alkyl group include a halogen atom, a nitro group, a cyano group, a hydroxyl group, an alkoxyl group, an aryl group, an acylamino group, an alkoxycarbonylamino group, a ureido group, an amino group, a heterocyclic group, an acyl group, a sulfamoyl group, a sulfonamido group, a thioureido group, a carbamoyl group, an alkylthio group, an arylthio group, a heterocyclic thio group and, in addition, a carboxyl group or sulfo group and a salt thereof. Of these, the ureido, thioureido, sulfamoyl, carbamoyl, and amino groups may be unsubstituted or substituted with an alkyl group or an aryl group at the N position thereof. The aryl group includes a phenyl group and a substituted phenyl group. Substituents for the substituted phenyl group include an alkyl group and the above-enumerated substituents for the alkyl group.

In formulae (II) and (III), the divalent linking group as represented by L includes

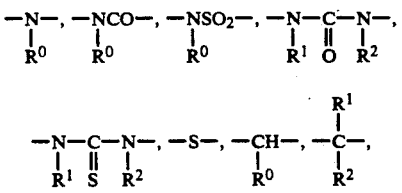

etc., and combinations thereof, wherein $R^0$, $R^1$, and $R^2$ each represents a hydrogen atom, an alkyl group (preferably having 1 to 5 carbon atoms), or an aralkyl group (preferably having 10 or less carbon atoms).

The compounds represented by formulae (I), (II), and (III) ar preferably employed in an amount of from to $1\times10^{-5}$ to $5\times10^{-2}$ mol, more preferably from $1\times10^{-4}$ to $1\times10^{-2}$ mol, per mol of silver halide.

Specific examples of compounds represented by formulae (I), (II), and (III) are shown below for illustrative purposes but the present invention is not to be construed as being limited to these compounds.

(I-1)

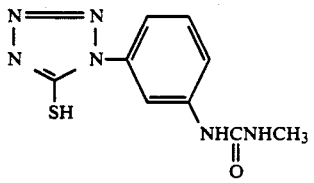

(I-2)

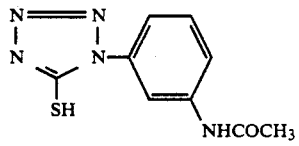

(II-1)

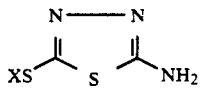

(II-2)

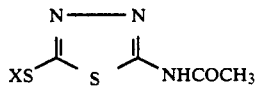

(III-1)

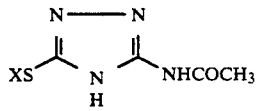

(III-2)

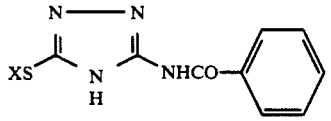

The dye represented by formula (A) which can be used in the present invention is described below in detail.

In formula (A), $R_{101}$ and $R_{102}$ each represents $-OR_{105}$, $-COOR_{105}$, $$-\underset{\underset{R_{106}}{|}}{CON}-R_{105},$$

$-COR_{105}$, $-CN$, or $-R_{107}$, wherein $R_{105}$ and $R_{106}$ each represents a hydrogen atom, a substituted or unsubstituted alkyl group (e.g., methyl, ethyl, butyl, hydroxyethyl, and phenethyl), or a substituted or unsubstituted aryl group (e.g., phenyl and hydroxyphenyl), and $R_{107}$ represents an alkyl group or an alkyl group substituted with a halogen atom, etc. (e.g., trifluoromethyl and tetrafluoroethyl); $R_{103}$ and $R_{104}$ each represents an alkyl, aralkyl or aryl group substituted with at least one of a sulfo group and a carboxyl group (e.g., sulfoethyl, sulfopropyl, sulfophenyl, sulfobenzyl, and carboxyphenyl); and $L_{101}$ represents a substituted or unsubstituted methine group.

Specific examples of the substituents of substituted alkyl group for $R_{105}$ and $R_{106}$ include hydroxy groups, cyano groups, carboxy groups, sulfo groups, and alkoxy groups having 1 to 6 carbon atoms. Specific examples of the substituents of substituted aryl group for $R_{105}$ and $R_{106}$ include alkyl groups having 1 to 6 carbon atoms, sulfo groups, carboxy groups, hydroxy groups, alkoxy groups having 1 to 6 carbon atoms, amino groups and halogen atoms.

Specific examples of the substituents of substituted methine group for $L_{101}$ include an alkyl group having 1 to 4 carbon atoms (e.g., methyl, ethyl, 2-sulfoethyl), an aryl group (e.g., phenyl), and a halogen atom (e.g., chlorine, bromine).

The amount of the compound of formula (A) to be used is determined so as to obtain the desired sharpness and is generally within the range of from about 0.1 to 500 mg, preferably from 5.0 to 100 mg, per $m^2$ of the light-sensitive material. If the amount is too small, only a small improvement in sharpness is obtained. If the amount is too large, the compound remains in the light-sensitive material after processing to give adverse influences to photographic properties, such as fog.

Specific examples of the compound of formula (A) are shown below for illustrative purposes only and the present invention is not to be construed as being limited thereby.

(A-1)

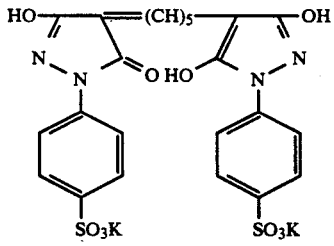

(A-2)

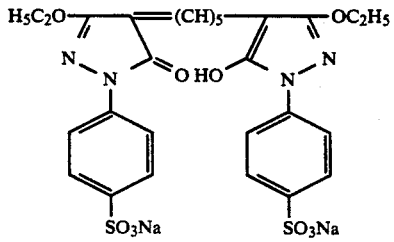

-continued
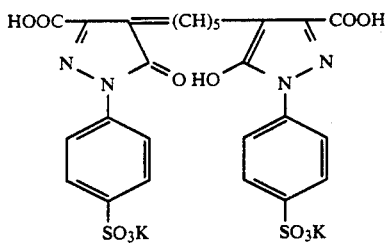
(A-3)
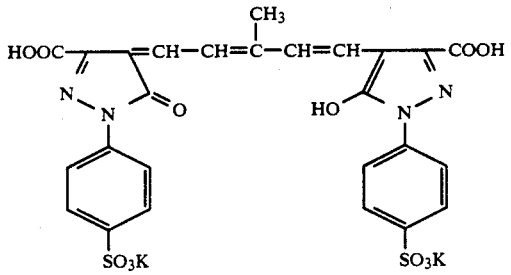
(A-4)
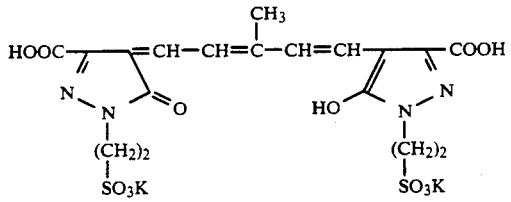
(A-5)
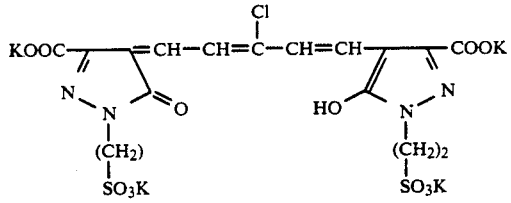
(A-6)
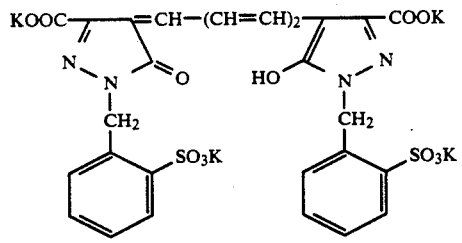
(A-7)
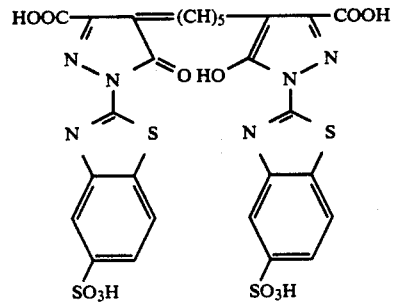
(A-8)

-continued
(A-9)
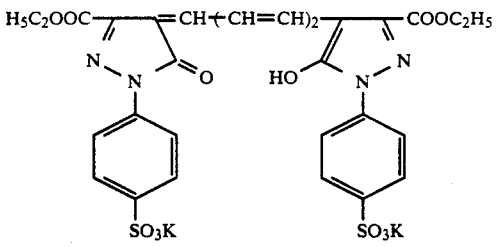
(A-10)
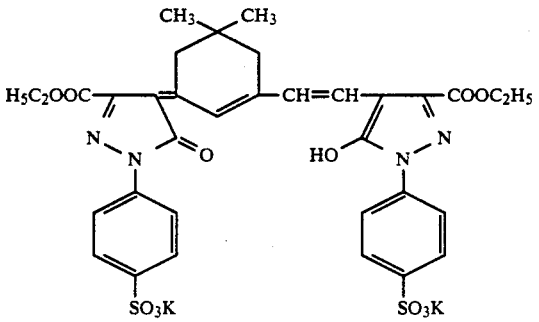
(A-11)
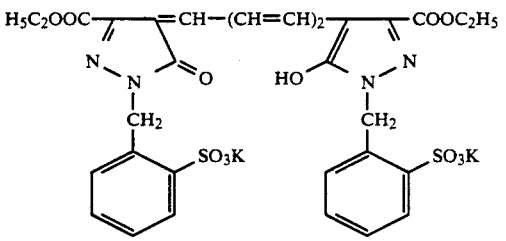
(A-12)
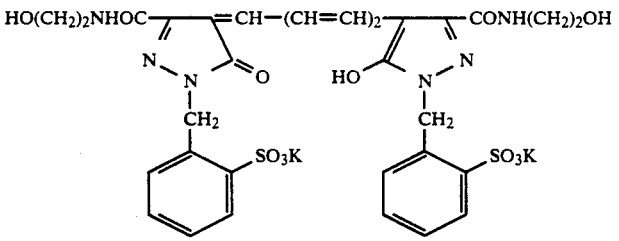
(A-13)
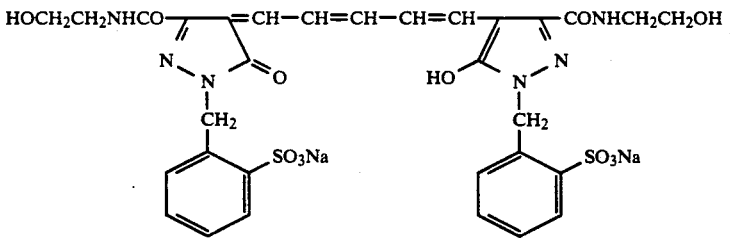
(A-14)
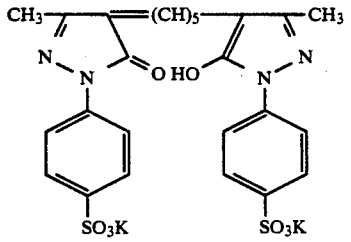

-continued
(A-15)
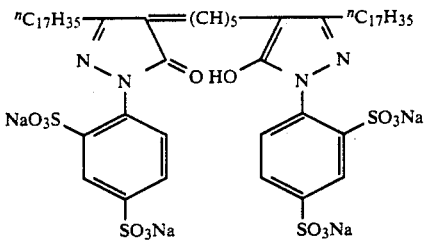
(A-16)
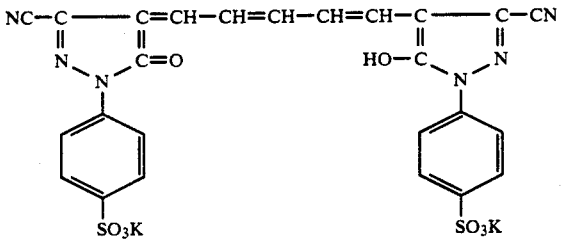
(A-17)
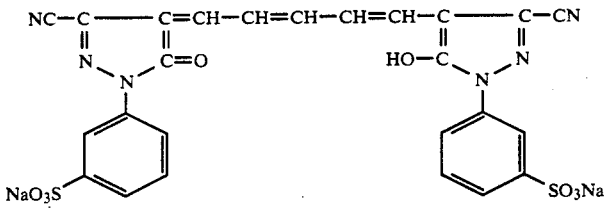
(A-18)
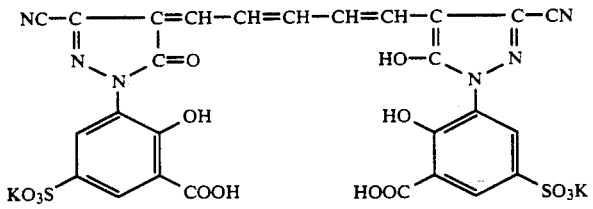
(A-19)
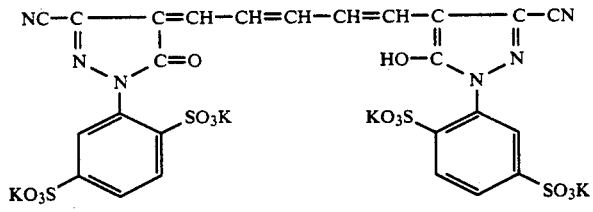
(A-20)
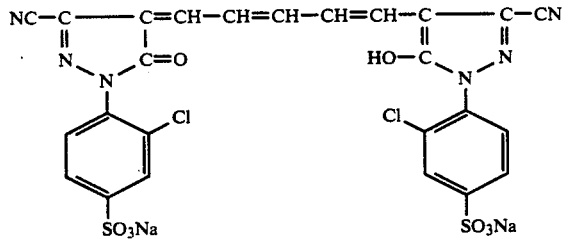
(A-21)
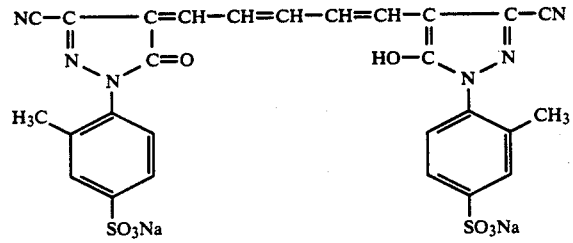

-continued
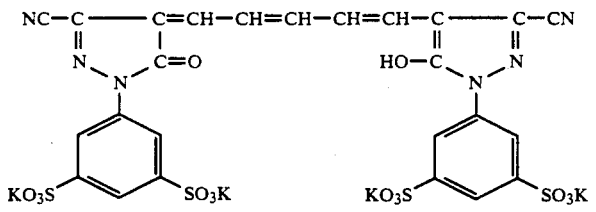
(A-22)
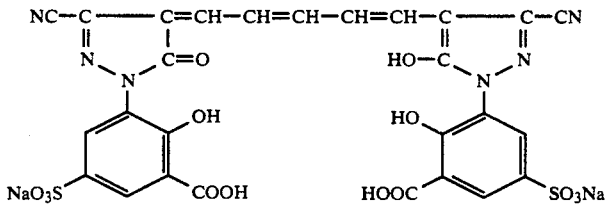
(A-23)
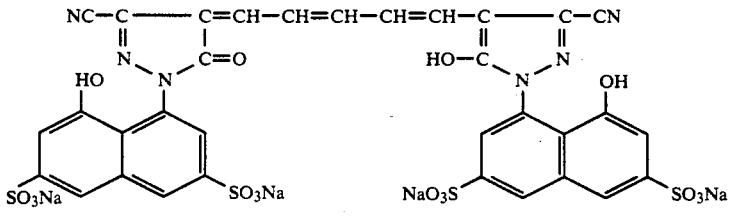
(A-24)
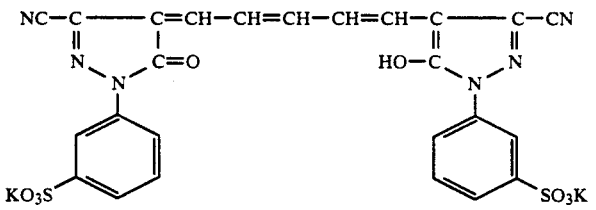
(A-25)
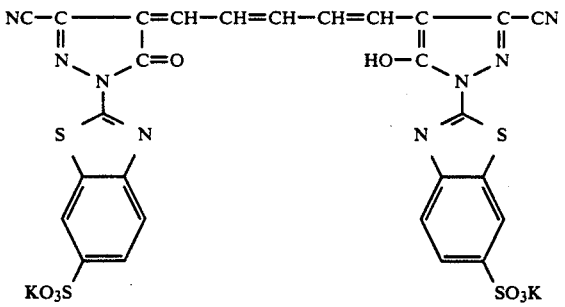
(A-26)
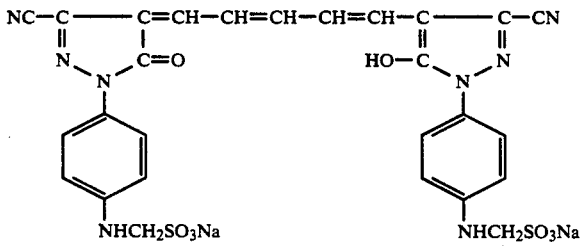
(A-27)

-continued
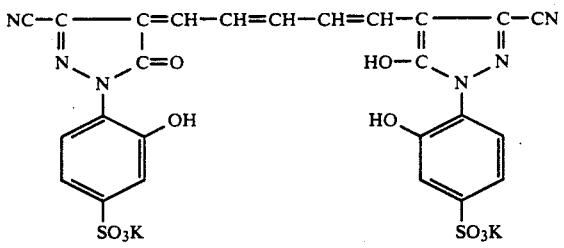
(A-28)
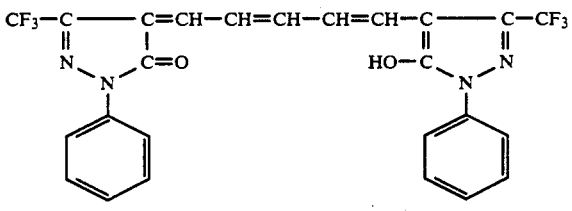
(A-29)
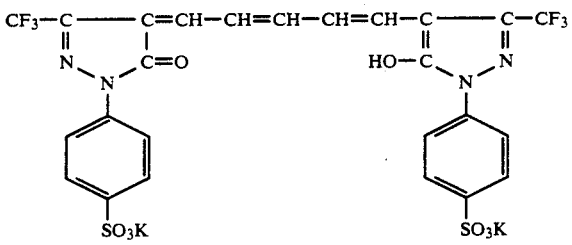
(A-30)
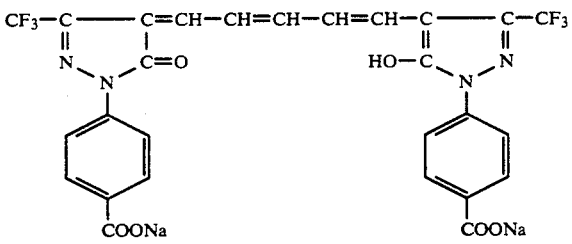
(A-31)
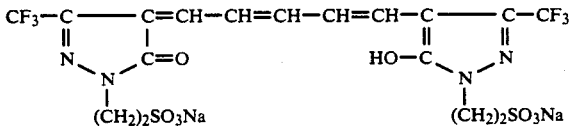
(A-32)
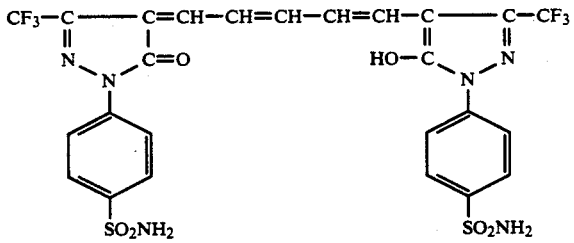
(A-33)
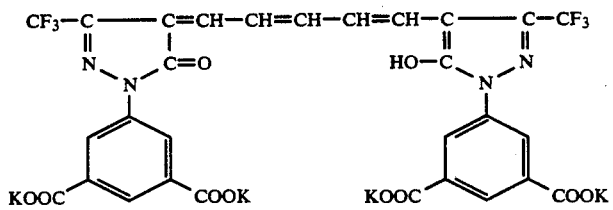
(A-34)

-continued
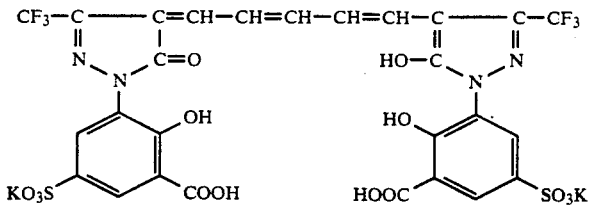
(A-35)
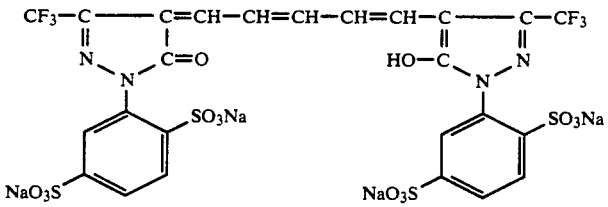
(A-36)
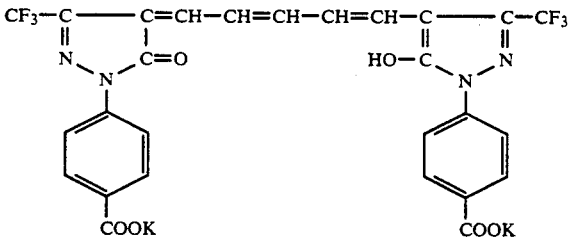
(A-37)
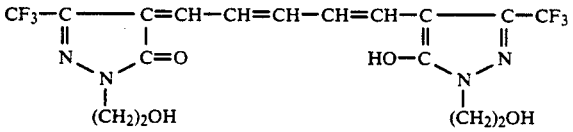
(A-38)
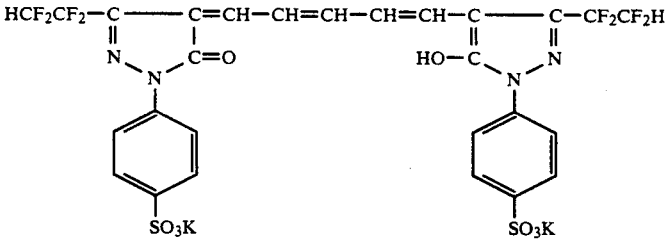
(A-39)
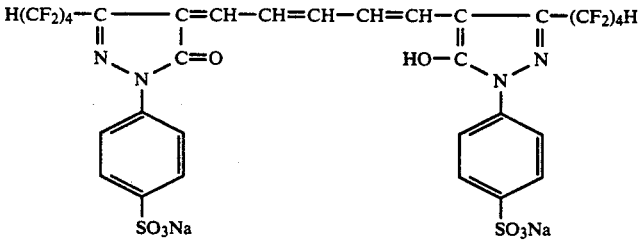
(A-40)
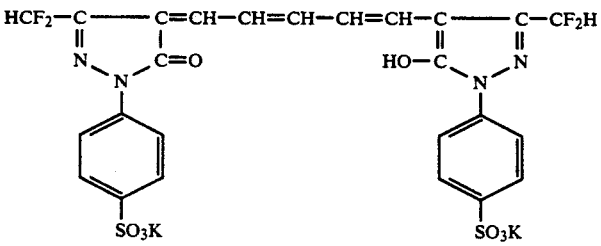
(A-41)

-continued (A-42)

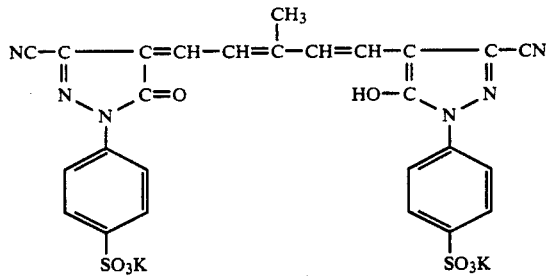

According to research studies, the transmission density of a reflective support to be used greatly influences image sharpness. It has been confirmed that the image sharpness decreases as the transmission density decreases. In particular, the transmission density as measured in the red region of visible light showed a pronounced correlation with sharpness. In the present invention, remarkable effects can be produced when a reflective support having a transmission density in the red region of from 0.2 to 0.9 is used. The terminology "transmission density in the red region" as used herein means the R density of the support as measured with a densitometer "X-Rite 310 Type" manufactured by The X-Rite Company. Where a paper support having polyethylene laminated on both sides thereof is used, if the laminate layers on both sides differ from each other in terms of the density of white pigment contained therein, the R density varies depending on whether light is irradiated from the surface side or back side of the support. Hence, the transmission density as specified in the present invention is the one obtained by taking a measurement with the side of a support on which emulsion layers are to be coated facing the detector.

When the transmission density is higher than 0.9, though no deterioration of sharpness occurs, it becomes difficult to make the light-sensitive material thin while maintaining a high transmission density. In addition, when the resulting color print is seen by illumination from its back side, the image becomes dark. If the transmission density is lower than 0.2, it is not difficult to reduce the thickness of the light-sensitive material, but the image becomes dark when observed using reflected light. From this point of view, the transmission density is preferably 0.88 or less, more preferably 0.86 or less.

The reflective support which can be used in this invention has improved reflectivity to render the dye image formed in the silver halide emulsion layers clearer. Suitable reflective supports includes a base coated with a hydrophobic resin having dispersed therein a light reflective substance, e.g., titanium oxide, zinc oxide, calcium carbonate and calcium sulfate, and a support comprising a hydrophobic resin having dispersed therein a light reflective substance. Examples of suitable reflective supports are baryta paper, polyethylene coated paper, polypropylene synthetic paper, and a transparent base, e.g., a glass sheet, a polyester film (e.g., polyethylene terephthalate, cellulose triacetate, and cellulose nitrate), a polyamide film, a polycarbonate film, a polystyrene film, and a vinyl chloride film, which is combined with a reflective layer or a reflective substance. These supports can be selected depending on the end use.

As a reflective substance, a white pigment is usually kneaded thoroughly in the presence of a surface active agent. It is preferred to pre-treat the surface of the pigment particle with a di- to tetrahydric alcohol.

The area ratio (%) of the white pigment particles per prescribed unit area can be obtained most typically by dividing the observed area into n unit areas of 6 μm×6 μm which are in contact with each other and measuring the ratio of the projected area occupied by the particles ($R_i$; %). The coefficient of variation of the area ratio ($R_i$) can be obtained from a ratio of the standard deviation (s) of $R_i$ to the mean value ($\overline{R}$) of $R_i$ ($s/\overline{R}$). The number of unit areas (n) is preferably 6 or more. The coefficient of variation $s/\overline{R}$ can thus be obtained from the equation:

$$s/\overline{R} = \sqrt{\frac{\sum_{n=1}^{n} (R_i - \overline{R})^2}{n-1}} \Big/ \frac{\sum_{i=1}^{n} R_i}{n}$$

In the present invention, the coefficient of variation (%) of the area ratio of the pigment particles is preferably not more than 0.15, more preferably not more than 0.12. When it is 0.08 or less, the dispersion of pigment particles can be regarded as substantially uniform.

The color photographic material according to the present invention comprises a support having coated thereon at least one blue-sensitive silver halide emulsion layer, at least one green-sensitive silver halide emulsion layer, and at least one red-sensitive silver halide emulsion layer. In general color papers, the emulsion layers are coated on a support in the order listed above, but different orders may also be employed. Color reproduction can be achieved by the subtractive color process in which each of the light-sensitive emulsion layers contains a silver halide emulsion with sensitivity in the respective wavelength regions and a so-called color coupler forming a dye complementary to the light to which the layer is sensitive, that is, a yellow dye complementary to blue, a magenta dye complementary to green, or cyan dye complementary to red. In some cases, the light sensitive layer and the hue developed by the coupler may not have such a relationship.

Spectral sensitization of each silver halide emulsion is performed for the purpose of endowing the emulsion with spectral sensitivity to a desired light wavelength region. In the present invention, spectral sensitization is preferably carried out by addition of a dye absorbing light in the wavelength region corresponding to the spectral sensitivity, i.e., spectral sensitizing dye. Examples of usable spectral sensitizing dyes are described, e.g., in F. H. Hamer, *Heterocyclic Compounds-Cyanine Dyes and Related Compounds*, John Wiley & Sons, New York, London (1964). Specific examples of preferred sensitizing dyes are described in JP-A-62-215272, page 22, upper right column to page 38.

The silver halide color photographic material according to the present invention should contain a so-called color coupler capable of forming a dye upon coupling reaction with an oxidation product of an aromatic primary amine developing agent. Usually employed couplers include compounds having an active methylene group and capable of forming an azomethine dye on coupling with an oxidation product of a developing agent. As stated above, these couplers are selected so as to form a combination of a yellow coupler, a magenta coupler, and a cyan coupler.

Yellow couplers preferably used in the present invention include acylacetamide derivatives, such as benzoylacetanilide and pivaloylacetanilide. Preferred couplers are those represented by formulae (Y-1) and (Y-2):

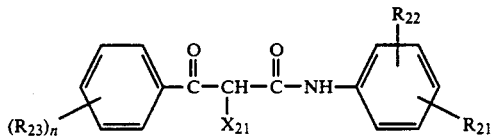
(Y-1)

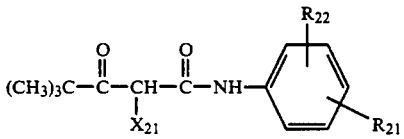
(Y-2)

wherein $X_{21}$ represents a hydrogen atom or a group releasable on coupling; $R_2I$ represents a non-diffusion group having from 8 to 32 carbon atoms in total; $R_{22}$ represents a hydrogen atom, or one or more of a halogen atom, a lower alkyl group, a lower alkoxyl group and a non-diffusion group having from 8 to 32 carbon atoms in total; $R_{23}$ represents a hydrogen atom or a substituent; two or more $R_{23}$, if present, may be the same or different; and n represents an integer of from 1 to 6.

Pivaloylacetanilide yellow couplers are described in detail in U.S. Pat. No. 4,622,287, Col. 3, line 15 to Col. 8, line 39 and U.S. Pat. No. 4,623,616, Col. 14, line 50 to Col. 19, line 41.

Benzoylacetanilide yellow couplers are described in detail in U.S. Pat. Nos. 3,408,194, 3,933,501, 4,046,575, 4,133,958, and 4,401,752.

Specific examples of pivaloylacetanilide yellow couplers include Compounds (Y-1) to (Y-39) disclosed in U.S. Pat. No. 4,622,287, Cols. 37 to 54. Preferred compounds are (Y-1), (Y-4), (Y-6), (Y-7), (Y-15), (Y-21), (Y-22), (Y-23), (Y-26), (Y-35), (Y-36), (Y-37), (Y-38), and (Y-39). Also additional examples are Compounds (Y-1) to (Y-33) listed in U.S. Pat. No. 4,623,616, Cols. 19 to 24. Preferred compounds are (Y-2), (Y-7), (Y-8), (Y-12), (Y-20), (Y-21), (Y-23), and (Y-29).

Other preferred yellow couplers include Compound (34) disclosed as a typical example in U.S. Pat. No. 3,408,194, Col. 6; Compounds (16) and (19) disclosed in U.S. Pat. No. 3,933,501, Col. 8; Compound (9) disclosed in U.S. Pat. No. 4,046,575, Cols. 7 and 8; Compound (1) disclosed in U.S. Pat. No. 4,133,958, Cols. 5 and 6; and Compounds disclosed in U.S. Pat. No. 4,401,752, Col. 5.

Of the above-described couplers, particularly preferred are those with a nitrogen atom as a releasable atom.

The magenta couplers which can be used in the present invention include oil-protect type indazolone or cyanoacetyl couplers, and preferably 5-pyrazolone couplers and pyrazoloazole couplers such as pyrazolotriazoles. The 5-pyrazolone couplers preferably include those substituted by an arylamino group or an acylamino group at the 3-position thereof from the standpoint of hue or density of the color developed. Typical examples of such couplers are described in U.S. Pat. Nos. 2,311,082, 2,343,703, 2,600,788, 2,908,573, 3,062,653, 3,152,896, and 3,936,015. The releasable group of 2-equivalent 5-pyrazolone couplers preferably includes nitrogen-releasable groups described in U.S. Pat. No. 4,310,619 and arylthio groups described in U.S. Pat. No. 4,351,897. 5-Pyrazolone couplers having a ballast group as described in European Patent 73636 provide high color densities.

Suitable pyrazoloazole couplers include pyrazolobenzimidazoles described in U.S. Pat. No. 2,369,879, preferably pyrazolo[5,1-c][1,2,4]triazoles described in U.S. Pat. No. 3,725,067, pyrazolotetrazoles described in *Research Disclosure,* No. 24220 (June, 1984), and pyrazolopyrazoles described in *Research Disclosure,* No. 24230 (June, 1984). The above-described couplers may be polymer couplers.

Specific examples of these magenta couplers are represented by formulae (M-1), (M-2), and M-3).

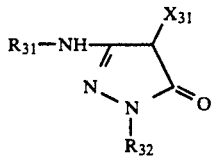
(M-1)

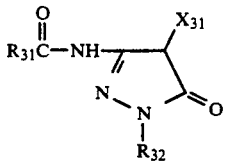
(M-2)

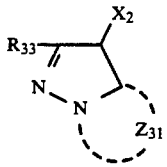
(M-3)

wherein $R_{31}$ represents a non-diffusion group having from 8 to 32 carbon atoms in total; $R_{32}$ represents a phenyl group or a substituted phenyl group; $R_{33}$ represents a hydrogen atom or a substituent; $Z_{31}$ represents a non-metallic atomic group necessary to form a 5-membered azole ring containing from 2 to 4 nitrogen atoms, this azole ring may have a substituent inclusive of a condensed ring; and $X_{31}$ represents a hydrogen atom or a releasable group.

In formula (M-3), the substituent represented by $R_{33}$ and the substituent of the azole ring are described in detail, e.g., in U.S. Pat. No. 4,540,654, Col. 2, line 41 to Col. 8, line 27.

Preferred pyrazoloazole couplers are imidazo[1,2-b]pyrazoles described in U.S. Pat. No. 4,500,630 from the standpoint of reduction of unnecessary yellow absorption and light-fastness of a color forming dye. The pyrazolo[1,5-b][1,2,4]triazoles described in U.S. Pat. No. 4,540,654 is particularly preferred.

Additional preferred pyrazoloazole magenta couplers are pyrazolotriazole couplers in which a branched alkyl group is directly bonded to the 2-, 3- or 6-position of the pyrazolotriazole ring thereof as described in JP-A-61-65245; pyrazoloazole couplers having a sulfonamide group in the molecule thereof as described in JP-A-61-65246; pyrazoloazole couplers having an alkoxyphenylsulfonamide group as a ballast group as described in JP-A-61-147254; and pyrazolotriazole couplers having an alkoxyl group or an aryloxy group at the 6-position thereof as described in European Patent (publication) 226,849.

Suitable cyan couplers which can be used in the present invention typically include phenol cyan couplers and naphthol cyan couplers.

Suitable phenol cyan couplers include those having an acylamino group and an alkyl group at the 2- and 5-positions of the phenol nucleus thereof, respectively, (inclusive of polymer couplers) as described in U.S. Pat. Nos. 2,369,929, 4,518,687, 4,511,647, and 3,772,002. Specific examples of these phenolic couplers are the coupler of Example 2 of Canadian Patent 625,822, Compound (1) of U.S. Pat. No. 3,772,002, Compounds (I-4) and (I-5) of U.S. Pat. No. 4,564,590, Compounds (1), (2), (3) and (24) of JP-A-61-39045, and Compound (C-2) of JP-A-62-70846.

Suitable phenol cyan couplers further include 2,5-diacylaminophenol couplers described in U.S. Pat. Nos. 2,771,162, 2,895,826, 4,334,011, and 4,500,653 and JP-A-59-164555. Specific examples of these couplers are Compound (V) of U.S. Pat. No. 2,895,826, Compound (17) of U.S. Pat. No. 4,557,999, Compounds (2) and (12) of U.S. Pat. No. 4,565,777, Compound (4) of U.S. Pat. No. 4,124,396, and Compound (I-19) of U.S. Pat. No. 4,613,564.

Suitable phenol cyan couplers furthermore include those having a nitrogen-containing heterocyclic ring condensed to the phenol nucleus thereof, as disclosed in U.S. Pat. Nos. 4,372,173, 4,564,586, and 4,430,423, JP-A-61-390441 and JP-A-62-257158. Typical examples of these couplers are Couplers (1) and (3) of U.S. Pat. No. 4,327,173, Compounds (3) and (16) of U.S. Pat. No. 4,564,586 and Compounds (1) and (3) of U.S. Pat. No. 4,430,423.

Examples of phenol cyan couplers additionally include ureide couplers described in U.S. Pat. Nos. 4,333,999, 4,451,559, 4,444,872, 4,427,767, and 4,579,813, and EP 067,689Bl. Typical examples of these couplers are Coupler (7) of U.S. Pat. No. 4,333,999, Coupler (1) of U.S. Pat. No. 4,451,559, Coupler (14) of U.S. Pat. No. 4,444,872, Coupler (3) of U.S. Pat. No. 4,427,767, Couplers (6) and (24) of U.S. Pat. No. 4,609,619, Couplers (1) and (11) of U.S. Pat. No. 4,579,813, Couplers (45) and (50) of EP 067,689Bl, and Coupler (3) of JP-A-61-42658.

Suitable naphthol cyan couplers include those having an N-alkyl-N-arylcarbamoyl group at the 2-position of the naphthol nucleus thereof (e.g., the couplers of U.S. Pat. No. 2,313,586), those having an alkylcarbamoyl group at the 2-position of the naphthol nucleus thereof (e.g., the couplers of U.S. Pat. Nos. 2,474,293 and 4,282,312), those having an arylcarbamoyl group at the 2-position [e.g., the couplers of JP-B-50-14523 (the term "JP-B" as used herein means an "examined Japanese patent publication")], those having a carbonamido or sulfonamido group at the 5-position (e.g., the couplers of JP-A-60-237448, JP A-61-145557, and JP-A-61-153640), those having an aryloxy releasable group (e.g., the couplers of U.S. Pat. No. 3,476,563), those having a substituted alkoxy releasable group (e.g., the couplers of U.S. Pat. No. 4,296,199), and those having a glycol releasable group (e.g., the couplers of JP-B-60-39217).

The above-described couplers can be incorporated into an emulsion layer in the form of a dispersion in at least one high-boiling organic solvent. Preferred high-boiling organic solvents to be used include those represented by formulae (A) to (E):

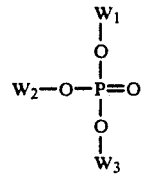

(A)

$$W_1—COO—W_2 \quad (B)$$

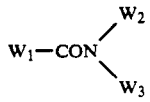

(C)

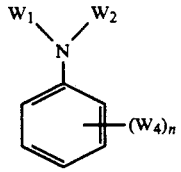

(D)

$$W_1—O—W_2 \quad (E)$$

wherein $W_1$, $W_2$, and $W_3$, which may be the same or different, each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $OW_1$, or $S—W_1$; n represents an integer of from 1 to 5; when n is 2 or more, $W_4$ may be the same or different; and $W_1$ and $W_2$ in formula (E) may form a condensed ring.

These couplers can be emulsified and dispersed in a hydrophilic colloid aqueous solution by impregnating such into a loadable latex polymer (see U.S. Pat. No. 4,203,716) in the presence or absence of the above-described high-boiling organic solvent or by dissolving such in a water-insoluble and organic solvent-soluble polymer. The homo- or co-polymers described in International Publication No. WO 88/00723, pp. 12–30 are preferably used. In particular, acrylamide polymers are preferred from the standpoint of the stability of the dye image formed.

The light-sensitive materials of this invention may contain color fog inhibitors, such as hydroquinone derivatives, aminophenol derivatives, gallic acid derivatives, and ascorbic acid derivatives.

The light-sensitive materials of this invention can also contain various kinds of discoloration inhibitors, such as organic discoloration inhibitors for cyan, magenta and/or yellow images. Representative examples of organic discoloration inhibitors include hydroquinones, 6-hydroxychromans, 5-hydroxycoumarans, spirochromans, p-alkoxyphenols, hindered phenols (typically hindered bisphenols), gallic acid derivatives, methylenedioxybenzenes, aminophenols, hindered amines, and ether or ester derivatives of these phenolic compounds in which the phenolic hydroxyl group is silylated or alkylated. Metal complexes typically including (bissalicylaldoximato) nickel complexes and (bis-N,N-di-alkyldithiocarbamato)nickel complexes can also be used.

These compounds are usually co-emulsified with the corresponding coupler in an amount of from 5 to 100% by weight based on the coupler weight and incorporated into the light-sensitive layer. In order to prevent heat- and particularly light-deterioration of a cyan dye image, it is more effective to incorporate a ultraviolet absorbent into each of the layers adjacent to a cyan color forming layer.

Particularly preferred of the above-described discoloration inhibitors are spiroindanes and hindered amines.

In the present invention, it is preferable to use the above-described couplers, particularly pyrazoloazole couplers, in combination with (F) a compound capable of chemically bonding to a residual aromatic amine developing agent which remains after color development processing to form a chemically inert and substantially colorless compound and/or (G) a compound capable of chemically bonding to a residual oxidation product of an aromatic amine developing agent which remains after color development processing to form a chemically inert and substantially colorless compound. Addition of these compounds is effective to prevent stain formation or other undersirable side effects due to color forming dye formation reaction between residual color developing agent or an oxidation product thereof and the coupler during, for example, storage after processing.

Compounds (F) preferably include those capable of reacting with p-anisidine at a second-order reaction rate constant k2 (in trioctyl phosphate at 80° C.) falling within a range of from 1.0 l/min.sec to $1\times10^{-5}$ l/min.sec. Compounds having a k2 larger than this range are liable per se and tend to be decomposed upon reaction with gelatin or water. Compounds having a k2 smaller than this range are slow to react with the residual aromatic amine developing agent, sometimes failing to achieve the object of preventing side effects of the residual aromatic amine developing agent.

More preferred of compounds (F) are those represented by formulae (F-1) and (F-II):

$$R_{41}-(A)_n-X_{41} \qquad \text{(F-1)}$$

$$R_{42}-\underset{\underset{B}{|}}{C}=Y_{41} \qquad \text{(F-II)}$$

wherein $R_{41}$ and $R_{42}$ each represents an aliphatic, aromatic or 5- to 7-membered heterocyclic group; n represents 1 or 0; B represents a hydrogen atom, an aliphatic, aromatic or 5- to 7-membered heterocyclic group, an acyl group, or a sulfonyl group; and $Y_{41}$ represents a group which accelerates the addition reaction of an aromatic amine developing agent to the compound of formula (F-II); $R_{41}$ and $X_{41}$ in formula (F-1) or $Y_{41}$ and $R_{42}$ or B in formula (F-II) may combine to form a cyclic structure.

The mode of chemical bonding between residual aromatic amine developing agent and the compound (F) typically includes a substitution reaction and an addition reaction.

Specific examples of compounds represented by formulae (F-1) and (F-II) are described in JP-A-63-249255, JP-A-1-55558, JP-A-1-57259 and JP-A-1-120554, Japanese Patent Application Nos. 62-158643 and 62-228034.

Details of the combination of the compound (G) and the compound (F) are described in JP-A-1-86139.

The light-sensitive material of the present invention may contain ultraviolet absorbents in the hydrophilic colloidal layers thereof. Examples of suitable ultraviolet absorbents include aryl-substituted benzotriazole compounds (e.g., the compounds described in U.S. Pat. No. 3,533,794), 4-thiazolidone compounds (e.g., the compounds described in U.S. Pat. Nos. 3,314,794 and 3,352,681), benzophenone compounds (e.g., the compounds described in JP-A-46-2784), cinnamic ester compounds (e.g., the compounds described in U.S. Pat. No. 3,705,805 and 3,707,375), butadiene compounds (e.g., the compounds described in U.S. Pat. No. 4,045,229), and benzoxidole compounds (e.g., the compounds described in U.S. Pat. No. 3,700,455). Ultraviolet absorbing couplers (e.g., α-naphthol cyan dye forming couplers) or ultraviolet absorbing polymers can also be used. The layer into which the ultraviolet absorbent is incorporated may be mordanted, if desired.

Suitable binders or protective colloids which can be used in the emulsion layers of the light-sensitive material of the present invention preferably include gelatin. Other hydrophilic colloids may also be used either alone or in combination with gelatin.

The gelatin which can be used includes both lime-processed gelatin and acid-processed gelatin. Details of the preparation of gelatin are described in Arthur Veis, *The Macromolecular Chemistry of Gelatin,* Academic Press (1964).

According to the present invention, the silver halide color photographic material as specified above is imagewise exposed and then subjected to color development processing to form a color image. The color development processing comprises color development, bleach-fix and washing (or stabilization).

In the present invention, the color developer contains chloride ion in a concentration of from $3.5\times10^{-2}$ to $1.5\times10^{-1}$ mol/l, preferably from $4\times10^{-2}$ to $1.0\times10^{-1}$ mol/l, and bromide ion in a concentration of from $3.0\times10^{-5}$ to $1.0\times10^{-3}$ mol/l, preferably from $5.0\times10^{-5}$ to $5.0\times10^{-4}$ mol/l. A chloride ion concentration exceeding $1.5\times10^{-1}$ mol/l retards development, resulting in a failure to obtain an image of high contrast within a short processing time. A chloride ion at a concentration less than $3.5\times10^{-2}$ mol/l accelerates development of the toe of the characteristic curve impairing the linearity of photographic response, resulting in a failure of favorable reproduction of gradation or an increase of fog through long-term continuous processing. If the bromide ion is higher than $1\times10^{-3}$ mol/l, development is retarded. If it is less than $3.0\times10^{-5}$ mol/l, development of the toe of the characteristic curve is similarly accelerated impairing the linearity of photographic response, resulting in a failure to satisfactorily reproduce gradation or in an increase for through long-term continuous processing. In addition, desilvering in the bleach-fix step becomes insufficient in continuous processing, resulting in an increase of residual silver amount.

It is not until the color light-sensitive material containing the specific silver halide grains is subjected to color development processing with a developer containing the specific concentrations of a chloride ion and a bromide ion that color prints of high quality can be produced rapidly and in a stable manner by using a silver halide color photographic material which has high sensitivity, can be rapidly processed, and exhibits excellent sharpness even in using a support having a low transmission density.

Further, such a color image formation system achieves a reduction in the size of light-sensitive materials thereby improving productivity. A color image formation method is also provided which can be applied to rapid processing of the light-sensitive material for transmission/reflection display with excellent sharpness. The applicability to this kind of light-sensitive material is a discovery utterly unanticipated from conventional knowledge.

Chloride and bromide ions can be incorporated into a developer in the desired concentrations by directly adding compounds capable of providing, on dissociation, the respective ion in a liquid and/or a solution thereof to the developer, or these ions can be supplied from the light-sensitive material by elution during development.

In the former case, substances supplying chloride ion include sodium chloride, potassium chloride, ammonium chloride, nickel chloride, magnesium chloride, manganese chloride, calcium chloride, and cadmium chloride, with sodium chloride and potassium chloride being preferred. Substances supplying bromide ion include sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide being preferred. Chloride ion or bromide ion may be supplied in the form of a salt of a fluorescent whitening agent which is added to a developer.

In the latter case, both chloride and bromide ions may be supplied from the emulsion layers or from other layers of the photographic material.

From the viewpoint of stable processing during continuous processing and prevention of streaky pressure marks, it is preferable that the color developer contains substantially no sulfite ion. In order to inhibit deterioration of the developer without using a sulfite preservative, it is recommended that the developer should not be used for a long time; physical means are taken to reduce the influence of air, such as use of a floating lid and reduction of the opening of a development tank; the temperature of the developer is controlled; and chemical means, such as addition of an organic preservative, are employed. Addition of an organic preservative is advantageous as a matter of convenience.

Suitable organic preservatives include organic compounds which, when added to a color developer, function to suppress deterioration of an aromatic primary amine color developing agent due to, for example, air-oxidation. Particularly effective organic preservatives include hydroxylamine derivatives (exclusive of hydroxylamine, hereinafter the same), hydroxamic acids, hydrazines, hydrazides, phenols, α-hydroxyketones, α-aminoketones, saccharides, monoamines, diamines, polyamines, quaternary ammonium salts, nitroxyl radicals, alcohols, oximes, diamide compounds, and condensed ring amines as described in JP-A-63-4235, JP-A-63-30845, JP-A-63-21647, JP-A-63- 44655, JP-A-63-53551, JP-A-63-43140, JP-A-63-56654, JP-A-63-58346, JP-A-63-43138, Japanese Patent Application No. 61-170756, JP-A-61-170756, JP-A-63-44657, JP-A-63-44656, U.S. Pat. Nos. 3,615,503 and 2,494,903, JP-A-52-143020, and JP-B-48-30496.

Preferred organic preservatives are described in detail hereinafter. These compounds described below are usually added to a color developer in a concentration of from 0.005 to 0.5 mol/l, preferably from 0.03 to 0.1 mol/l.

Addition of hydroxylamine derivatives and/or hydrazine derivatives is particularly desirable.

Hydroxylamine derivatives preferably include those represented by formula (IV):

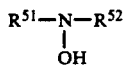

(IV)

wherein $R^{51}$ and $R^{52}$, which may be the same or different, each represents a hydrogen atom, a substituted or unsubstituted alkyl group, a substituted or unsubstituted alkenyl group, a substituted or unsubstituted aryl group, or a heterocyclic aromatic group, or $R^{51}$ and $R^{52}$ can combine to form a 5- or 6-membered heterocyclic ring together with the nitrogen atom, provided that $R^{51}$ and $R^{52}$ do not simultaneously represent a hydrogen atom.

In formula (IV), $R^{51}$ and $R^{52}$ each preferably represents an alkyl or alkenyl group having from 1 to 10, and particularly from 1 to 5, carbon atoms. Preferred substituents for $R^{51}$ and $R^{52}$ include hydroxyl, alkoxyl, alkylsulfonyl, arylsulfonyl, amide, carboxyl, cyano, sulfo, nitro, and amino groups. The heterocyclic ring formed by $R^{51}$-N-$R^{52}$ may be saturated or unsaturated and comprises a carbon atom, a hydrogen atom, a halogen atom, an oxygen atom, a nitrogen atom, a sulfur atom, etc. Such a heterocyclic ring includes piperidyl, pyrrolidinyl, N-alkylpiperazyl, morpholyl, indolinyl, and benzotriazole rings.

Specific examples of the hydroxylamine derivatives of formula (IV) are shown below.

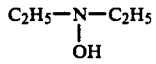

IV-1

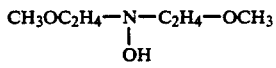

IV-2

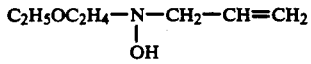

IV-3

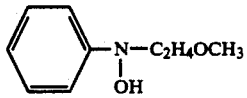

IV-4

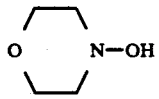

IV-5

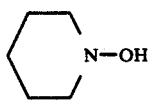

IV-6

-continued

IV-7

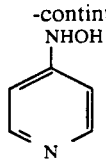

IV-8

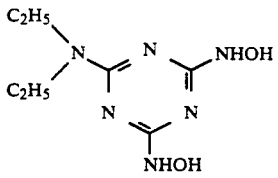

The hydrazines and hydrazides preferably include those represented by formula (V):

(V)

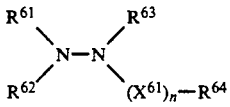

wherein $R^{61}$, $R^{62}$, and $R^{63}$, which may be the same or different, each represents a hydrogen atom, a substituted or unsubstituted alkyl group, a substituted or unsubstituted aryl group, or a substituted or unsubstituted heterocyclic group; $R^{64}$ represents a hydroxyl group, a hydroxylamino group, a sutstituted or unsubstituted alkyl group, a substituted or unsubstituted aryl group, a substituted or unsubstituted, saturated or unsaturated 5- or 6-membered heterocyclic group comprising of a carbon atom, a hydrogen atom, an oxygen atom, a nitrogen atom, a sulfur atom, a halogen atom, etc., a substituted or unsubstituted alkoxyl group, a substituted or unsubstituted aryloxy group, a substituted or unsubstituted carbamoyl group, or a substituted or unsubstituted amino group; $X^{61}$ represents a divalent group selected from —CO—, —$SO_2$— and $$-\overset{\overset{\displaystyle NH}{\|}}{C}-;$$

and n represents 0 or 1; provided that when n is 0, $R^{64}$ is selected from an alkyl group, an aryl group, and a heterocyclic group; $R^{63}$ and $R^{64}$ may combine to form a heterocyclic group.

In formula (V), $R^{61}$, $R^{62}$, and $R^{63}$ each preferably represents a hydrogen atom or an alkyl group having from 1 to 10 carbon atoms. $R^{61}$ and $R^{62}$ each more preferably represents a hydrogen atom.

$R^{64}$ preferably represents an alkyl group, an aryl group, an alkoxyl group, a carbamoyl group, or an amino group, and more preferably an alkyl group or a substituted alkyl group. Preferred substituents for the alkyl group include a carboxyl group, a sulfo group, a nitro group, an amino group, a phosphono group, etc. $X^{61}$ preferably represents —CO— or $SO_2$—, more preferably —CO—.

Specific examples of the hydrazines and hydrazides represented by formula (V) are shown below.

V-1

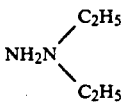

-continued

V-2

$NH_2NH(CH_2)_4SO_3H$

V-3

$NH_2NH(CH_2)_2SO_3H$

V-4

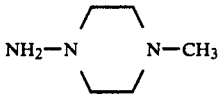

V-5

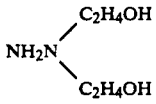

V-6

$NH_2NHCOCH_3$

V-7

$NH_2NHCOOC_2H_5$

V-8

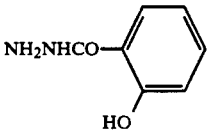

V-9

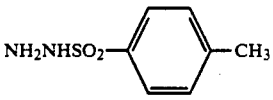

V-10

$NH_2NHCONH_2$

V-11

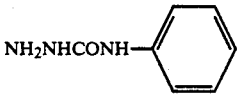

V-12

$NH_2NHSO_3H$

V-13

$$NH_2NH\overset{\overset{\displaystyle NH}{\|}}{C}NH_2$$

V-14

$NH_2NHCOCONHNH_2$

V-15

$NH_2NHCH_2CH_2CH_2SO_3H$

V-16

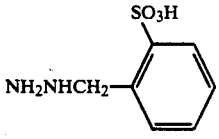

V-17

$$NH_2NH\underset{\underset{\displaystyle C_4H_9(n)}{|}}{CH}COOH$$

V-18

$NH_2NHCH_2CH_2COOH$

V-19

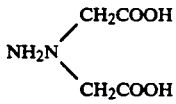

V-20

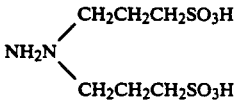

V-21

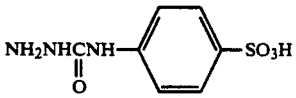

-continued

V-22

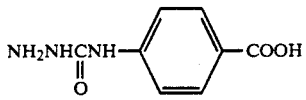

To improve stability of a color developer and ultimately assure stable continuous processing, it is preferred to use a compound represented by formula (IV) or (V) in combination with an amine represented by formula (VI) or (VII):

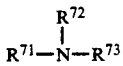

(VI)

wherein $R^{71}$, $R^{72}$, and $R^{73}$ each represents a hydrogen atom, a substituted or unsubstituted alkyl group, a substituted or unsubstituted alkenyl group, a substituted or unsubstituted aryl group, a substituted or unsubstituted aralkyl group, or a substituted or unsubstituted heterocyclic group; or $R^{71}$ and $R^{72}$, $R^{71}$ and $R^{73}$ or $R^{72}$ and $R^{73}$ may combine to form a nitrogen-containing heterocyclic ring.

In formula (VI), $R^{71}$, $R^{72}$, and $R^{73}$ each preferably represents a hydrogen atom or an alkyl group. Examples of substituents for $R^{71}$, $R^{72}$, or $R^{73}$ include a hydroxyl group, a sulfo group, a carboxyl group, a halogen atom, a nitro group, an amino group, etc.

Specific examples of the amine compounds represented by formula (VI) are shown below.

$N(CH_2CH_2OH)_3$ VI-1

$H_2NCH_2CH_2OH$ VI-2

$HN(CH_2CH_2OH)_2$ VI-3

$C_7H_{15}N(CH_2CH(OH)CH_2OH)_2$ VI-4

VI-5

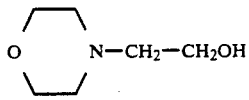

VI-6

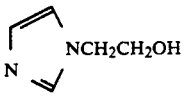

VI-7

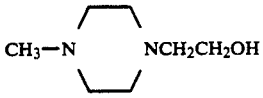

VI-8

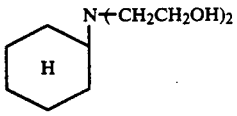

VI-9

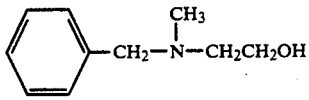

$(HOCH_2CH_2)_2NCH_2CH_2SO_2CH_3$ VI-10

$HN(CH_2COOH)_2$ VI-11

-continued $HOOCCH_2CH_2CH(NH_2)COOH$ VI-12

$H_2NCH_2CH_2SO_2NH_2$ VI-13

VI-14

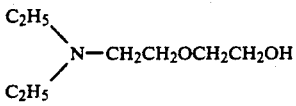

$H_2N-C(CH_2OH)_2$ VI-15

$HOCH_2CH(NH_2)COOH$ VI-16

VI-17

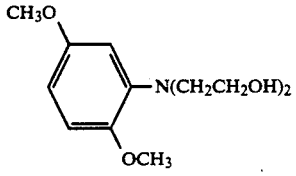

VI-18

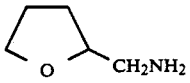

VI-19

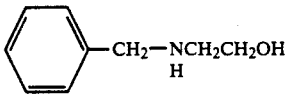

VI-20

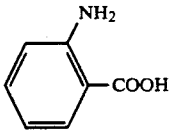

(VII)

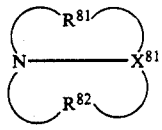

wherein $X_{81}$ represents a trivalent atomic group necessary to complete a condensed ring; and $R^{81}$ and $R^{82}$, which may be the same or different; each represents an alkylene group, an arylene group, an alkenylene group, or an aralkylene group.

Of the compounds represented by formula (VII), preferred are those represented by formulae (VII-a) and (VII-b).

(VII-a)

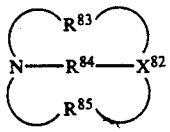

wherein $X^{82}$ represents

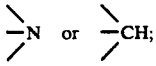

$R^{83}$ and $R^{84}$ are as defined in formula (VII) for $R^{81}$ and $R^{82}$; and $R^{85}$ represents $R^{83}$, $R^{84}$, or $$-CH_2\overset{\overset{O}{\|}}{C}-.$$

In formula (VII-a), $X^{82}$ preferably represents $$-\overset{\diagup}{\underset{\diagdown}{N}}.$$

$R^{83}$, $R^{84}$, and $R^{85}$ each preferably contains not more than 6 carbon atoms, more preferably not more than 3, most preferably 2. $R^{83}$, $R^{84}$, and $R^{85}$ each preferably represents an alkylene group or an arylene group, more preferably an alkylene group.

(VII-b)

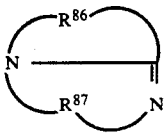

wherein $R^{86}$ and $R^{87}$ are as defined for $R^{81}$ and $R^{82}$ in formula (VII).

In formula (VII-b), $R^{86}$ and $R^{87}$ each preferably contains not more than 6 carbon atoms. $R^{86}$ and $R^{87}$ each preferably represents an alkylene group or an arylene group, more preferably an alkylene group.

Of the compounds represented by formulae (VII-a) and (VII-b), those of formula (VII-a) are preferred.

Specific examples of the compounds represented by formula (VII) are shown below.

VII-1

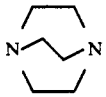

VII-2

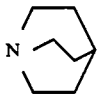

VII-3

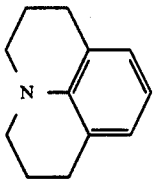

VII-4

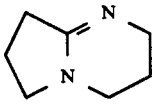

VII-5

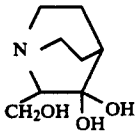

VII-6

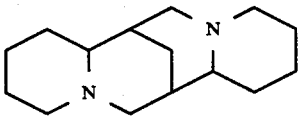

-continued

VII-7

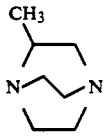

VII-8

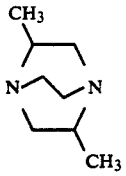

VII-9

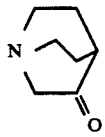

VII-10

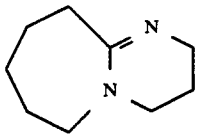

VII-11

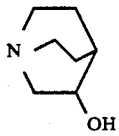

VII-12

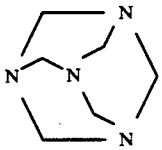

VII-13

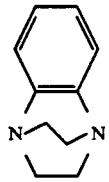

VII-14

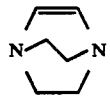

VII-15

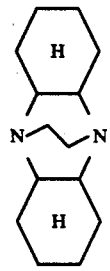

VII-16

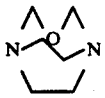

-continued

VII-17

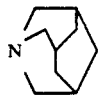

VII-18

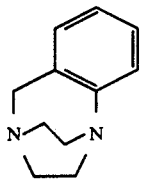

The above-described organic preservatives are commercially available or can be synthesized according to the method described in JP-A-63 170642 and JP-A-63-239447.

The color developer which can be used in the present invention contains a known aromatic primary amine color developing agent, preferably a p-phenylenediamine developing agent. Typical examples of p-phenylenediamine developing agents are shown below for illustrative purposes only.

D-1: N,N-Diethyl-p-phenylenediamine

D-2: 4-[N-Ethyl-N-(β-hydroxyethyl)amino]aniline

D-3: 2-Methyl-4-[N-ethyl-N-[β-hydroxyethyl-)amino]aniline

D-4: 4-Amino-3-methyl-N-ethyl-N (β-methanesulfonamidoethyl)aniline

These p-phenylenediamine derivatives may be in the form of a salt, such as a sulfate, a hydrochloride, and a p-toluenesulfonate salt.

The aromatic primary amine developing agent is used at a concentration of from about 0.1 to 20 g per liter, preferably from about 0.5 to 10 g per liter.

The pH of the color developer is preferably between 9 and 12, more preferably between 9 and 11.0.

The color developer can contain other known components. For example, various buffering agents are preferably added for controlling the pH within the above-recited range. Examples of buffering agents include sodium carbonate, potassium carbonate, sodium bicarbonate, potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffering agent is preferably used in a concentration of at least 0.1 mol/l, more preferably from 0.1 to 0.4 mol/l.

In addition, various chelating agents can be added to a color developer to prevent precipitation of calcium or magnesium or to improve the stability of the color developer. Specific examples of chelating agents which can be used are nitrilotriacetic acid, diethylenetriaminepentaacetic acid, ethylenediamine-tetraacetic acid, triethylenetetraminehexa-acetic acid, N,N,N-trimethylenephosphonic acid, ethylenediamine-N,N,N',N'-tetramethylenephosphonic acid, 1,3-diamino-2-propanoltetraacetic acid, trans-cyclohexanediaminetetraacetic acid, nitrilotripropionic acid, 1,2-diaminopropanetetraacetic acid, hydroxyethyliminodiacetic acid, glycol ether diaminetetraacetic acid, hydroxyethylenediaminetriacetic acid, ethylenediamineorthohydroxyphenylacetic acid, 2-n-butane-1,2,4-tricarboxylic acid, 1-hydroxyethylidene-1,1-diphosphonic acid, N,N'-bis(2-hydroxybenzyl) ethylenediamine-N,N'-diacetic acid, catechol-3,4,6 trisulfonic acid, catechol-3,5-disulfonic acid, 5-sulfosalicylic acid, and 4-sulfosalicylic acid.

If desired, these chelating agents may be used as a combination of two or more thereof.

These chelating agents are used in amounts sufficint to sequester metallic ions in a color developer, for example, from about 0.1 to 10 g per liter.

If desired, the color developer may contain an an appropriate development accelerator. Examples of development accelerators include the thioether compounds as described in JP-B-37-16088, JP-B-37-5987, JP-B-38-7826, JP-B-44-12380, JP-B-45-9019, and U.S. Pat. No. 3,813,247; the p-phenylenediamine compounds as described in JP-A-52-49829 and JP-A-50-15554; the quaternary ammonium salts as described in JP-A-50-137726, JP-B-44-30074, JP-A-56-156826, and JP-A-52-43429; the p-aminophenols as described in U.S. Pat. Nos. 2,610,122 and 4,119,462; the amine compounds as described in U.S. Pat. Nos. 2,494,903, 3,128,182, 4,230,796, and 3,253,919, JP-B-41-11431, and U.S. Pat. Nos. 2,482,546, 2,596,926, and 3,582,346; the polyalkylene oxides as described in JP-B-37-16088, JP-B-42-25201, U.S. Pat. No. 3,128,183, JP-B-41-11431, JP-B-42-23883, and U.S. Pat. No. 3,532,501; and the 1-phenyl-3-pyrazolidones, hydrazines, meso-ionic compounds, ionic compounds, imidazoles, and so on.

To minimize variations in photographic characteristics in continuous processing it is preferred for the color developer to contain substantially no benzyl alcohol. The term "substantially no benzyl alcohol" means that the developer contains not more than 2.0 ml/l of benzyl alcohol. More preferably, the color developer does not contain any benzyl alcohol at all.

If desired, the color developer may further contain other antifoggants in addition to chloride and bromide ions, such as alkali metal halides, e.g., potassium iodide, and organic antifoggants. Typical examples of suitable organic antifoggants include nitrogen-containing heterocyclic compounds, e.g., benzotriazole, 6-nitrobenzimidazole, 5-nitroisoindazole, 5-methyl-benzotriazole, 5-nitrobenzotriazole, 5-chlorobenzotriazole, 2-thiazolylbenzimidazole, 2-thiazolylmethylbenzimidazole, imidazole, hydroxyazaindolizine, and adenine.

In the case of continuous processing, the rate of developer replenishment is desirably minimized from the standpoint of a saving of resources and reduction in environmental pollution. A preferred rate of color developer replenishment is not more than 200 ml, more preferably not more than 120 ml, most preferably not more than 100 ml, per $m^2$ or a light-sensitive material. The terminology "rate of replenishment" as used herein means the amount of a color developer replenisher supplied per unit area of light-sensitive material for making up for the consumption and excludes the amounts of additives and the like which are supplied for correcting aging or evaporation loss.

The color developer preferably contains a fluorescent whitening agent, e.g., 4,4'-diamino-2,2'-disulfostilbene compounds. The fluorescent whitening agent is usually added in a concentration of up to 10 g/l, preferably from 0.1 to 6 g/l.

If desired, the color developer may additionally contain various surface active agents, e.g., alkylsulfonic acids, arylphosphonic acids, aliphatic carboxylic acids, and aromatic carboxylic acids.

Color development with the color developer is usually carried out at a temperature ranging from 20° to 50° C., preferably from 30° to 40° C., for a period of from 20 seconds to 5 minutes, preferably from 30 seconds to 2 minutes.

The color development is followed by desilvering. Desilvering generally comprises bleaching and fixation, either separately or simultaneously, preferably simultaneously.

The bleaching solution or bleach-fix solution can contain a re-halogenating agent, such as a bromide (e.g., potassium bromide, sodium bromide, and ammonium bromide), a chloride (e.g., potassium chloride, sodium chloride, and ammonium chloride), and an iodide (e.g., ammonium iodide). If desired, the bleaching or bleach-fix solution can further contain one or more organic or inorganic acids and alkali metal or ammonium salts thereof having a pH buffering ability (e.g., boric acid, borax, sodium metaborate, acetic acid, sodium acetate, sodium carbonate, potassium carbonate, sulfurous acid, phosphoric acid, sodium phosphate, citric acid, sodium citrate, and tartaric acid) or a corrosion inhibitor (e.g., ammonium nitrate and guanidine).

The bleach-fix solution or a fixing solution contains one or more known fixing agents, i.e., water-soluble silver halide solvents, such as thiosulfates (e.g., sodium thiosulfate and ammonium thio-sulfate), thiocyanates (e.g., sodium thiocyanate and ammonium thiocyanate), thioether compounds (e.g., ethylene bisthioglycolic acid and 3,6-dithia-1,8-octanediol), and thioureas. A special bleach-fix solution containing a fixing agent in combination with a large quantity of a halogenating agent, e.g., potassium iodide, as disclosed in JP-A-55-155354 can also be used. In the present invention, thiosulfates, particularly ammonium thiosulfate, are preferred as a fixing agent.

The fixing agent is used in a concentration of from 0.3 to 2 mol/l, preferably from 0.5 to 1.0 mol/l.

The bleach-fix or fixing solution preferably has a pH ranging from 3 to 10, more preferably from 5 to 9. If the pH is lower than 3, desilvering performance is improved, but deterioration of the processing solution is accelerated and the cyan dye tends to be rendered colorless. If the pH is higher than 10, desilvering is retarded, and stains tend to appear.

If desired, the bleach-fix or fixing solution can contain hydrochloric acid, sulfuric acid, nitric acid, acetic acid, bicarborate, ammonia, caustic potash, caustic soda, sodium carbonate, potassium carbonate, etc., to adjust the pH.

The bleach-fix solution can further contain various fluorescent whitening agents, defoaming agents, surface active agents, and organic solvents, e.g., polyvinylpyrrolidone and methanol The bleach-fix or fixing solution contains, as a preservative, a sulfite ion-releasing compound, such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). These sulfite ion-releasing compounds are preferably added in concentrations of from about 0.02 to 0.50 mol/l, more preferably from 0.04 to 0.40 mol/l, on a sulfite ion conversion.

While sulfites are generally added as preservatives, other preservatives, such as ascorbic acid, carbonyl bisulfite adducts, sulfinic acids, or carbonyl compounds, may also be used.

If desired, the bleach-fix or fixing solution may additionally contain buffering agents, chelating agents, antifungal agents, etc.

After desilvering, i.e., fixation or bleach-fix, the silver halide color photographic material is usually subjected to washing and/or stabilization.

The amount of water to be used in the washing can vary widely depending on the characteristics of the light-sensitive material which depends, for example, on the materials used therein, e.g., couplers; the end use of the light-sensitive material; the temperature of water; the number of washing tanks (i.e., the number of the washing stages); the replenishment system (whether a direct flow system or a counter flow system); and other conditions. Specifically, the relationship between the number of washing tanks and the amount of water can be obtained by the method described in *Journal of the Society of Motion Picture and Television Engineers,* Vol. 64, pp. 248-253 (May, 1955).

According to the multi-stage counter-flow washing system described in the above-cited reference, although the requisite quantity of water can be greatly reduced, a problem arises in that increased retention time of water in a washing tank causes proliferation of bacteria, finally resulting in deposition of floc onto the light-sensitive material. This problem can be effectively reduced by reducing the calcium and magnesium contents of water as described in JP-A-63-288838. Use of bactercidal agents is also applicable. Usable bactericidal agents include isothiazolone compounds as described in JP-A-57-8542, thiabendazoles, chlorine-containing bactericides (e.g., chlorinated isothianuric acid sodium salt), benzotriazoles, and bactericides described in Hiroshi Horiguchi, *Bokin Bobaizai no Kagaku,* Eisei Gijutsukai (ed.), *Biseibutsu no Mekkin, Sakkin, Bobai Gijutsu,* and Nippon Bokin Bobai Gakkai (ed.), *Bokin Bobaizai Jiten.*

The washing water has a pH of from 4 to 9, preferably from 5 to 8. The temperature of the water and the washing time can also vary widely depending on the characteristics of the light-sensitive material, the end use of the light-sensitive material, and the like. Usually, washing is carried out at 15° to 45° C. for 20 seconds to 10 minutes, preferably at 25° to 40° C. for 30 seconds to 5 minutes.

Stabilization can be substituted for the above-described washing step. Such a stabilization step in substitution for washing can be effected by any of known techniques, such as those described in JP-A-57-8543, JP-A-58-14834, JP-A-59-184343, JP-A-60-220345, JP-A-60-238832, JP-A-60-239784, JP-A-60-239749, JP-A-61-4054, and JP-A-61- 118749. In particular, a stabilizing solution containing 1-hydroxyethylidene-1,1-diphosphonic acid, 5-chloro-2-methyl-4-isothiazolin-3-one, a bismuth compound, an ammonium compound, etc. is preferably employed.

In some cases, the above-described washing step may be followed by stabilization. Such a case is exemplified by a final bath for processing color light-sensitive materials for photography, where the bath contains formaldehyde and a surface active agent.

The processing time is the time required from contact of the light-sensitive material with the color developer to removal from the final bath (generally a washing or stabilizing bath). The effects of the present invention are significantly manifested in rapid processing completed within 4 minutes and 30 seconds, preferably within 4 minutes, as the above-defined processing time.

The present invention is now illustrated in greater detail by way of the following Examples, but it should be understood that the present invention is not to be construed as being limited thereto. In these examples, all the percents given are by weight unless otherwise indicated.

EXAMPLE 1

A multilayer color light-sensitive material was prepared having the following layer structure. This sample was designated as Sample 101.

The coating compositions for each layer were prepared as follows.

Coating Composition for First Layer:

In 150 ml of ethyl acetate, 1.0 ml of a solvent (Solv-3), and 3.0 ml of a solvent (Solv-4) were dissolved 60.0 g of a yellow coupler (ExY) and 28.0 g of a dye image stabilizer (Cpd-1), and the resulting solution was added to 450 ml of a 10% gelatin aqueous solution containing 20 ml of a 10% sodium dodecylbenzenesulfonate aqueous solution, followed by vigorous stirring to obtain an emulsified dispersion. The resulting dispersion was subjected to gold-sulfur sensitization and then mixed with a silver chlorobromide emulsion (comprising cubic grains having a silver bromide content of 0.7 mol % and a mean grain size of 0.9 μm) which had been spectrally sensitized with a blue-sensitive sensitizing dye shown below to prepare a coating composition of the First layer.

The coating compositions for the Second to Seventh Layers were prepared in the same manner as described above. Each layer further contained 1,2-bis(vinylsulfonyl)ethane as a gelatin hardening agent.

The spectral sensitizing dye used in each emulsion layer was as follows.

Blue-Sensitive Emulsion Layer:

Sodium 3-(2-[5-chloro-3-(3-sulfonatopropyl)benzothiazolin-2-ylidenemethyl]-5-chlorobenzothiazolio)-propanesulfonate (Added amount: $4.0\times10^{-4}$ mol/mol-Ag)

Green-Sensitive Emulsion Layer:

Sodium 2-[5-phenyl 2-(2-[5-phenyl-3-(2-sulfonatoethyl)-benzoxazolin-2-ylidenemethyl]-1-butenyl)-3-benzoxazolio]ethanesulfonate (Added amount: $4.0\times10^{-4}$ mol/mol-Ag)

Red-Sensitive Emulsion Layer:

2-[2,4-(2,2-Dimethyl-1,3-propano)-5-(3-ethylbenzothiazolin-2-ylidene)-1,3-pentadienyl]-3-ethyl-5-methoxybenzothiazolium iodide (Added amount: $6.0\times10^{-5}$ mol/mol-Ag)

Each emulsion layer further contained a 7:2:1 (molar basis) mixture of 1 (2-acetamidophenyl)-5-mercaptotetrazole, 1-phenyl 5-mercaptotetrazole, and 1-(4-methoxyphenyl)-5-mercaptotetrazole as a stabilizer in an amount of $8.0\times10^{-4}$ mol per mol of silver.

In addition, a magenta dye shown below in an amount of 8.0 mg/m² and a cyan dye as shown in Table 1 below in the amount shown were used for the Three and Fifth Layers, respectively, as anti-irradiation dyes.

Magenta Dye:

-continued

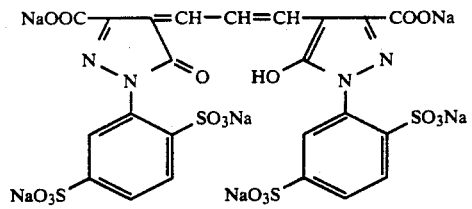

| | |
|---|---|
| Layer Structure: | |
| Support: | |
| Polyethylene-laminated (on both sides) paper support (transmission density in the red region = 0.95) | |
| First Layer (Blue-Sensitive Layer): | |
| Silver Halide Emulsion (AgBr: 0.7 mol %, cubic grains; mean grain size: 0.9 μm) | 0.27 g of Ag/m² |
| Gelatin | 1.80 g/m² |
| Yellow Coupler (ExY) | 0.60 g/m² |
| Dye Image Stabilizer (Cpd-1) | 0.28 g/m² |
| Solvent (Solv-3) | 0.01 g/m² |
| Solvent (Solv-4) | 0.03 g/m² |
| Second Layer (Color Mixing Preventing Layer): | |
| Gelatin | 0.80 g/m² |
| Color Mixing Inhibitor (Cpd-2) | 0.055 g/m² |
| Solvent (Solv-1) | 0.03 g/m² |
| Solvent (Solv-2) | 0.015 g/m² |
| Third Layer (Green-Sensitive Layer): | |
| Silver Halide Emulsion (AgBr: 0.7 mol %; cubic grains; mean grain size: 0.45 μm) | 0.28 g of Ag/m² |
| Gelatin | 1.40 g/m² |
| Magenta Coupler (ExM) | 0.67 g/m² |
| Discoloration Inhibitor (Cpd-3) | 0.23 g/m² |
| Discoloration Inhibitor (Cpd-4) | 0.11 g/m² |
| Solvent (Solv-1) | 0.20 g/m² |
| Solvent (Solv-2) | 0.02 g/m² |
| Fourth Layer (Color Mixing Preventing Layer): | |
| Gelatin | 1.70 g/m² |
| Color Mixing Inhibitor (Cpd-1) | 0.065 g/m² |
| Ultraviolet Absorbent (UV-1) | 0.45 g/m² |
| Ultraviolet Absorbent (UV-2) | 0.23 g/m² |
| Solvent (Solv-1) | 0.05 g/m² |
| Solvent (Solv-2) | 0.05 g/m² |
| Fifth Layer (Red-Sensitive Layer): | |
| Silver Halide Emulsion (AgBr: 2 mol %; cubic grains; mean grain size: 0.5 μm) | 0.19 g of Ag/m² |
| Gelatin | 1.80 g/m² |
| Cyan Coupler (ExC-1) | 0.26 g/m² |
| Cyan Coupler (ExC-2) | 0.12 g/m² |
| Discoloration Inhibitor (Cpd-2) | 0.20 g/m² |
| Solvent (Solv-1) | 0.16 g/m² |
| Solvent (Solv-2) | 0.09 g/m² |
| Sixth Layer (Ultraviolet Absorbing Layer): | |
| Gelatin | 0.70 g/m² |
| Ultraviolet Absorbent (UV-1) | 0.26 g/m² |
| Ultraviolet Absorbent (UV-2) | 0.07 g/m² |
| Solvent (Solv-1) | 0.30 g/m² |
| Solvent (Solv-2) | 0.09 g/m² |
| Seventh Layer (Protective Layer): | |
| Gelatin | 1.07 g/m² |

The compounds used in the preparation of Sample 101 were as follows:

Yellow Coupler (ExY):

α-Pivalyl-α-(3-benzyl-1-hydantoinyl)-2-chloro-5-[β-(dodecylsulfonyl)butylamido]acetanilide Magenta Coupler (ExM):

1-(2,4,6-Trichlorophenyl)-3-[2-chloro-5-(3-octadecenylsuccinimido)anilino]-5-pyrazolone Cyan Coupler (ExC-1):

2-Pentafluorobenzamido-4-chloro-5[2-(2,4-di-t-amylphenoxy)-3-methylbutylamidophenol Cyan Coupler (ExC-2):

2,4-Dichloro-3-methyl-6-[α-(2,4-di-t-amylphenoxy)-butylamido]phenol

Dye Image Stabilizer (Cpd-1):

2,5-Di-t-amylphenyl-3,5-di-t-butylhydroxybenzoate

Color Mixing Inhibitor (Cpd-2):

2,5-Di-t-octylhydroquinone

Discoloration Inhibitor (Cpd-3):

1,4-Di-t-amyl-2,5-dioctyloxybenzene

Discoloration Inhibitor (Cpd-4):

2,2'-Methylenebis(4-methyl-6-t-butylphenol)

Solvent (Solv-1):

Di(2-ethylhexyl)phthalate

Solvent (Solv-2):

Dibutyl phthalate

Solvent (Solv-3):

Di(i-nonyl) phthalate

Solvent (Solv-4):

N,N-Diethylcarbonamidomethoxy-2,4-di-t-amylbenzene

Ultraviolet Absorbent (UV-1):

2-(2-Hydroxy-3,5-di-t-amylphenyl)benzotriazole

Ultraviolet Absorbent (UV-2):

2-(2-Hydroxy-3,5-di-t-butylphenyl)benzotriazole

Samples 102 to 113 were prepared in the same manner as Sample 101, except for varying the transmission R density of the support used, the silver chloride content of each silver halide emulsion, and the kind and amount of cyan dye used as an anti-irradiation dye as shown in Table 1 below.

-continued

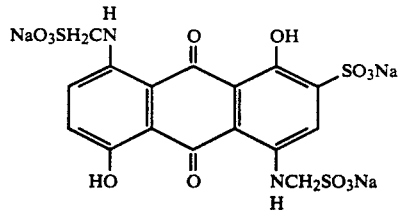

Each of Samples 101 to 113 was sensitometrically exposed to light through an optical wedge and a blue, green or red filter using a sensitometer "FWH Type" manufactured by Fuji Photo Film Co., Ltd. (color temperature: 3200K). The exposure was conducted at an exposure amount of 250 CMS for 1/10th second.

Each exposed sample was subjected to color development processing with an automatic developing machine according to the following procedure using the following processing solutions.

| Processing Procedure: | | |
|---|---|---|
| Processing Step | Temperature (°C.) | Time (sec) |
| Color Development | 38 | 45 |
| Bleach-Fix | 30–36 | 45 |
| Washing (1)* | 30–37 | 30 |
| Washing (2)* | 30–37 | 30 |
| Washing (3)* | 30–37 | 30 |
| Drying | 70–80 | 60 |

| Color Developer: | |
|---|---|
| Water | 800 ml |
| Ethylenediamine-N,N,N',N'-tetramethylenephosphonic Acid | 3.0 g |
| Organic Preservative (V-1) | 4.5 g |
| Triethanolamine | 10.0 g |
| Sodium Chloride | see Table 2 |
| Potassium Bromide | see Table 2 |
| Potassium Carbonate | 25.0 g |
| N-Ethyl-N-(-methanesulfonamidoethyl)-3-methyl-4-aminoaniline Sulfate | 5.0 g |
| Fluorescent Whitening Agent (4,4'-diaminostilbene type) | 1.2 g |
| Water to make | 1000 ml |
| pH (25° C.) | 10.05 |
| **Bleach-Fix Solution:** | |
| Water | 400 ml |
| Ammonium Thiosulfate (55% aq. soln.) | 100 ml |
| Ammonium Sulfite | 17.0 g |
| Ammonium (Ethylenediaminetetraacetate)-iron (III) | 55.0 g |
| Disodium Ethylenediaminetetraacetate | 5.0 g |
| Ammonium Bromide | 40.0 g |
| Glacial Acetic Acid | 9.0 g |
| Water to make | 1000 ml |

TABLE 1

| | Sample No. | | | | | | | | | | | | |
|---|---|---|---|---|---|---|---|---|---|---|---|---|---|
| | 101 | 102 | 103 | 104 | 105 | 106 | 107 | 108 | 109 | 110 | 111 | 112 | 113 |
| Transmission R Density of Reflective Support | 0.95 | 0.95 | 0.85 | 0.85 | 0.85 | 0.85 | 0.85 | 0.85 | 0.85 | 0.30 | 0.30 | 0.15 | 0.15 |
| AgCl Content (mol %): | | | | | | | | | | | | | |
| Blue-Sensitive Emulsion | 99.3 | 99.3 | 99.3 | 99.3 | 99.3 | 99.3 | 95.0 | 80.0 | 70.0 | 99.3 | 99.3 | 99.3 | 99.3 |
| Green-Sensitive Emulsion | 99.3 | 99.3 | 99.3 | 99.3 | 99.3 | 99.3 | 95.0 | 80.0 | 70.0 | 99.3 | 99.3 | 99.3 | 99.3 |
| Red-Sensitive Emulsion | 98.0 | 98.0 | 98.0 | 98.0 | 98.0 | 98.0 | 95.0 | 80.0 | 70.0 | 98.0 | 98.0 | 98.0 | 98.0 |
| Anti-irradiation Dye: | | | | | | | | | | | | | |
| Kind | A-16 | A-16 | A-16 | A-16 | C-(a) | C-(b) | A-16 | A-16 | A-16 | A-16 | A-16 | A-16 | A-16 |
| Amount (mg/m$^2$) | 15.0 | 30.0 | 15.0 | 30.0 | 30.0 | 30.0 | 30.0 | 30.0 | 30.0 | 20.0 | 40.0 | 30.0 | 60.0 |

Comparative Cyan Dye (C-a):

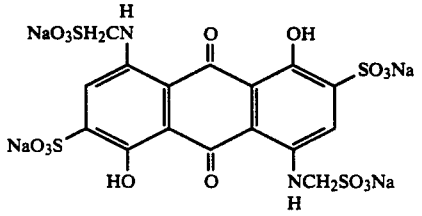

Comparative Cyan Dye (C-b):

-continued

| | |
|---|---|
| pH (25° C.) | 5.40 |

Washing Solution:

Ion-exchanged water containing not more than 3 ppm of each of calcium and magnesium.

The yellow, magenta, and cyan densities of the thus processed sample were measured with a densitometer to prepare the respective characteristic curves, and the respective density of fog, maximum density and sensitivity were obtained therefrom. The sensitivity was defined as the reciprocal of the exposure amount providing a density of fog +0.5 and is expressed relatively taking that of Sample 104 processed according to Run No. 4 of Table 2 as a standard (100). In order to evaluate the linearity of the gradation, the exposure amount giving a density of 1.0 was taken as a reference standard (0), and the increase in exposure amount necessary to increase the density by 0.5 over the standard and the decrease in exposure amount necessary to decrease the density by 0.5 against the standard were measured, both being expressed as a positive logarithmic unit value ($E^{+0.5}$, $E^{-0.5}$). The difference therebetween ($E^{+0.5}-E^{-0.5}$) was taken as an indication of gradation linearity.

Further, in order to examine the variations in photographic characteristics when the sample was exposed to light under high humidity conditions, the same sensitometry as described above was repeated but under conditions of 25° C. and 85% RH (relative humidity), and a decrease in sensitivity was determined.

Furthermore, in order to evaluate the sharpness of the resulting image, the CTF of the reflection density was determined at a spatial frequency of 6 cycle/mm using the cyan dye image (because the sharpness of the cyan dye image was the rate-determining step).

The results of these measurements are shown in Table 2 below.

TABLE 2

| | Run No. | | | | | | |
|---|---|---|---|---|---|---|---|
| | 1 | 2 | 3 | 4 | 5 | 6 | 7 |
| Sample No. | 101 | 102 | 103 | 104 | 105 | 106 | 107 |
| Ion Concn. in Developer (mol/l): | $6.0 \times 10^{-2}$ | $6.0 \times 10^{-2}$ | $6.0 \times 10^{-2}$ | $6.0 \times 10^{-2}$ | $6.0 \times 10^{-2}$ | $6.0 \times 10^{-2}$ | $6.0 \times 10^{-2}$ |
| $Cl^-$ | $6.0 \times 10^{-2}$ | $6.0 \times 10^{-2}$ | $6.0 \times 10^{-2}$ | $6.0 \times 10^{-2}$ | $6.0 \times 10^{-2}$ | $6.0 \times 10^{-2}$ | $6.0 \times 10^{-2}$ |
| $Br^-$ | $2.1 \times 10^{-4}$ | $2.1 \times 10^{-4}$ | $2.1 \times 10^{-4}$ | $2.1 \times 10^{-4}$ | $2.1 \times 10^{-4}$ | $2.1 \times 10^{-4}$ | $2.1 \times 10^{-4}$ |
| Fog: | | | | | | | |
| B | 0.09 | 0.09 | 0.09 | 0.09 | 0.10 | 0.11 | 0.09 |
| G | 0.08 | 0.09 | 0.08 | 0.09 | 0.10 | 0.11 | 0.09 |
| R | 0.09 | 0.10 | 0.09 | 0.10 | 0.12 | 0.14 | 0.09 |
| Relative Sensitivity: | | | | | | | |
| B | 115 | 102 | 113 | 100 | 84 | 79 | 104 |
| G | 122 | 101 | 121 | 100 | 93 | 89 | 102 |
| R | 149 | 104 | 146 | 100 | 97 | 93 | 105 |
| Maximum Density: | | | | | | | |
| B | 2.32 | 2.31 | 2.30 | 2.32 | 2.30 | 2.31 | 2.30 |
| G | 2.55 | 2.56 | 2.54 | 2.55 | 2.52 | 2.51 | 2.54 |
| R | 2.76 | 2.73 | 2.74 | 2.75 | 2.76 | 2.73 | 2.75 |
| $E^{+0.5}-E^{-0.5}$: | | | | | | | |
| B | −0.01 | −0.02 | −0.01 | −0.02 | −0.05 | −0.06 | −0.02 |
| G | −0.03 | −0.04 | −0.03 | −0.04 | −0.08 | −0.09 | −0.04 |
| R | −0.03 | −0.03 | −0.03 | −0.03 | −0.04 | −0.04 | −0.04 |
| Sensitivity Decrease on Exposure at High Humidity: | | | | | | | |
| B | −8 | −9 | −7 | −8 | −42 | −58 | −6 |
| G | +4 | +2 | +5 | +3 | −2 | −11 | +7 |
| R | +9 | +8 | +9 | +8 | +3 | −3 | +8 |
| CTF Value of Cyan Dye Image (6 c/mm) | 0.80 | 0.86 | 0.76 | 0.82 | 0.81 | 0.79 | 0.83 |
| Remarks | Comparison | Comparison | Invention | Invention | Invention | Comparison | Invention |

| | Run No. | | | | | | |
|---|---|---|---|---|---|---|---|
| | 8 | 9 | 10 | 11 | 12 | 13 | 14 |
| Sample No. | 108 | 109 | 110 | 111 | 112 | 113 | 104 |
| Ion Concn. in Developer (mol/l): | $6.0 \times 10^{-2}$ | $6.0 \times 10^{-2}$ | $6.0 \times 10^{-2}$ | | | | |
| $Cl^-$ | $6.0 \times 10^{-2}$ | $6.0 \times 10^{-2}$ | $6.0 \times 10^{-2}$ | $6.0 \times 10^{-2}$ | $6.0 \times 10^{-2}$ | $6.0 \times 10^{-2}$ | 0 |
| $Br^-$ | $2.1 \times 10^{-4}$ | $2.1 \times 10^{-4}$ | $2.1 \times 10^{-4}$ | $2.1 \times 10^{-4}$ | $2.1 \times 10^{-4}$ | $2.1 \times 10^{-4}$ | 0 |
| Fog: | | | | | | | |
| B | 0.08 | 0.08 | 0.08 | 0.10 | 0.10 | 0.12 | 0.13 |
| G | 0.09 | 0.09 | 0.09 | 0.10 | 0.10 | 0.11 | 0.12 |
| R | 0.09 | 0.08 | 0.10 | 0.13 | 0.11 | 0.15 | 0.14 |
| Relative Sensitivity: | | | | | | | |
| B | 109 | 91 | 99 | 86 | 93 | 68 | 109 |
| G | 105 | 88 | 102 | 79 | 95 | 73 | 108 |
| R | 108 | 84 | 116 | 51 | 89 | 47 | 111 |
| Maximum Density: | | | | | | | |
| B | 2.29 | 2.01 | 2.33 | 2.30 | 2.31 | 2.28 | 2.43 |
| G | 2.53 | 2.27 | 2.52 | 2.51 | 2.53 | 2.47 | 2.61 |

TABLE 2-continued

| | | | | | | | |
|---|---|---|---|---|---|---|---|
| R | 2.71 | 2.48 | 2.75 | 2.72 | 2.74 | 2.65 | 2.79 |
| $E^{+0.5}-E^{-0.5}$: | | | | | | | |
| B | −0.02 | −0.01 | −0.01 | −0.03 | −0.02 | −0.04 | −0.08 |
| G | −0.04 | −0.02 | −0.04 | −0.05 | −0.04 | −0.06 | −0.15 |
| R | −0.03 | −0.02 | −0.03 | −0.04 | −0.04 | −0.05 | −0.13 |
| Sensitivity Decrease on Exposure at High Humidity: | | | | | | | |
| B | −7 | −8 | −7 | −8 | −8 | −14 | −7 |
| G | +7 | +8 | +7 | +4 | +3 | −3 | +3 |
| R | +8 | +9 | +8 | +6 | +8 | 0 | +8 |
| CTF Value of Cyan Dye Image (6 c/mm) | 0.82 | 0.82 | 0.71 | 0.80 | 0.63 | 0.72 | 0.80 |
| Remarks | Invention | Comparison | Invention | Invention | Comparison | Comparison | Comparison |

| | Run No. | | | | | |
|---|---|---|---|---|---|---|
| | 15 | 16 | 17 | 18 | 19 | 20 |
| Sample No. | 104 | 104 | 104 | 104 | 104 | 104 |
| Ion Concn. in Developer (mol/l): | | | | | | |
| $Cl^-$ | $6.0 \times 10^{-2}$ | 0 | $3.0 \times 10^{-2}$ | $3.5 \times 10^{-2}$ | $1.5 \times 10^{-1}$ | $3.0 \times 10^{-1}$ |
| $Br^-$ | 0 | $2.1 \times 10^{-4}$ | $2.1 \times 10^{-5}$ | $3.0 \times 10^{-5}$ | $1.0 \times 10^{-3}$ | $2.0 \times 10^{-3}$ |
| Fog: | | | | | | |
| B | 0.12 | 0.12 | 0.11 | 0.10 | 0.08 | 0.07 |
| G | 0.11 | 0.11 | 0.10 | 0.09 | 0.08 | 0.07 |
| R | 0.13 | 0.12 | 0.11 | 0.11 | 0.09 | 0.08 |
| Relative Sensitivity: | | | | | | |
| B | 106 | 105 | 105 | 103 | 97 | 86 |
| G | 104 | 103 | 103 | 102 | 98 | 88 |
| R | 108 | 106 | 107 | 104 | 96 | 81 |
| Maximum Density: | | | | | | |
| B | 2.41 | 2.39 | 2.38 | 2.35 | 2.28 | 2.14 |
| G | 2.59 | 2.38 | 2.58 | 2.56 | 2.51 | 2.39 |
| R | 2.77 | 2.78 | 2.67 | 2.75 | 2.69 | 2.57 |
| $E^{+0.5}-E^{-0.5}$: | | | | | | |
| B | −0.07 | −0.07 | −0.05 | −0.03 | −0.01 | −0.01 |
| G | −0.12 | −0.11 | −0.08 | −0.05 | −0.03 | −0.03 |
| R | −0.09 | −0.08 | −0.06 | −0.04 | −0.02 | −0.02 |
| Sensitivity Decrease on Exposure at High Humidity: | | | | | | |
| B | −8 | −8 | −7 | −6 | −7 | −7 |
| G | +3 | +4 | +3 | +3 | +4 | +4 |
| R | +7 | +8 | +7 | +7 | +8 | +8 |
| CTF Value of Cyan Dye Image (6 c/mm) | 0.81 | 0.81 | 0.81 | 0.82 | 0.82 | 0.83 |
| Remarks | Comparison | Comparison | Comparison | Invention | Invention | Comparison |

It can be seen from the results in Table 2 that light-sensitive materials containing silver halide emulsions having high silver chloride contents exhibit high maximum color densities even when rapidly processed, but the samples containing comparative anti-irradiation dyes undergo a considerable reduction in sensitivity when exposed under high humidity conditions. When the antiirradiation dyes according to the present invention are employed, this adverse effect is not observed, but the linearity of gradation is impaired (that is, as the difference ($E^{+0.5}-E^{-0.5}$)increases in a negative manner, the toe gets flattened, i.e., becomes soft, to cause the characteristic curve to break) unless the specific developer according to the present invention is used.

The present invention thus makes it possible to form a color image by rapid processing without imparing the photographic characteristics even when dyes are used to conpensate for a deteriorated sharpness resulting from low transmission densities of a reflective support.

If the chloride and bromide ion concentrations of the developer are less than the levels specified in the present invention, linearity of gradation cannot be assured. If these concentrations are more than the specified levels, on the other hand, development is inhibited, resulting in a reduction in color density.

EXAMPLE 2

Emulsified dispersions of a color coupler, etc. were prepared in the same manner as in Example 1 and combined with each of the silver chlorobromide emulsions shown below. The resulting coating compositions were coated on a paper support, which had been coated on both sides with polyethylene, (transmission R density: 0.80) according to the layer structure described below to obtain a multilayer color light-sensitive material.

Blue-Sensitive Emulsion:

Silver Bromide Content: 0.6 mol %

Mean Grain Size: 1.12 μm

Coefficient of Variation of Grain Size: 0.07

Grain Form: cube (with local phases having a silver bromide content of about 20% being fused to the corners of the individual grains.)

Green-Sensitive Emulsion:

Silver Bromide Content: 1.3 mol %
Mean Grain Size: 0.45 μm

Each of the emulsions contained the following spectral sensitizing dyes.

Blue-Sensitive Emulsion:

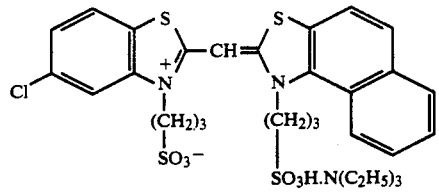

($2.0 \times 10^{-4}$ mol/mol of silver halide)

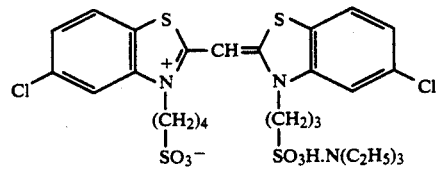

($2.0 \times 10^{-4}$ mol/mol of silver halide)

Green-Sensitive Emulsion:

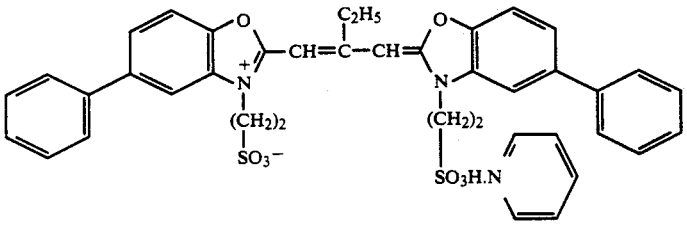

($4.0 \times 10^{-4}$ mol/mol of silver halide)

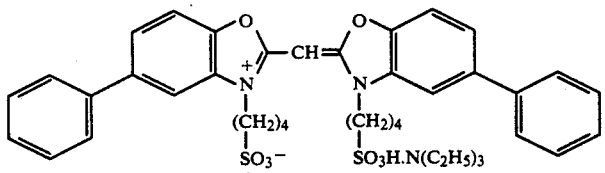

($7.0 \times 10^{-5}$ mol/mol of silver halide)

Red-Sensitive Emulsion:

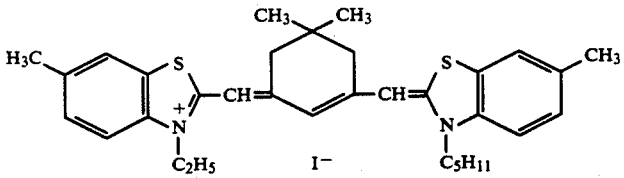

($0.9 \times 10^{-4}$ mol/mol of silver halide)

Coefficient of Variation of Grain Size: 0.08
Grain Form: cube
(with local phases having a silver bromide content of about 30% being fused to the corners of the individual grains.)

Red-Sensitive Emulsion:
Silver Bromide Content: 2.2 mol %
Mean Grain Size: 0.36 μm
Coefficient of Variation of Grain Size: 0.09
Grain Form: cube
(with local phases having a silver bromide content of about 40% being fused to the corners of the individual grains.

Each of the silver halide emulsions further contained a stabilizer shown below in an amount of $5.0 \times 10^{-4}$ mol per mol of silver halide.

Stabilizer:

-continued

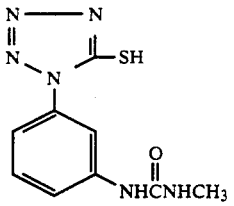

The red-sensitive emulsion layer furthermore contained a compound shown below in an amount of $2.6\times10^{31\ 3}$ per mol of silver halide.

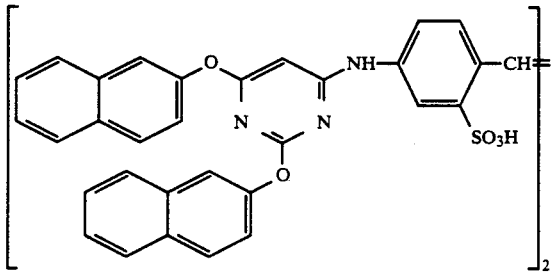

Each of the layers of the light-sensitive material contained 14.0 mg of sodium 1-hydroxy-3,5-dichloro-s-triazine per gram of gelatin as a gelatin hardening agent.

Additionally, 8.0 mg/m$^2$ of a magenta dye shown below was used as an anti-irradiation dye. The thus prepared light-sensitive material was designated as Sample 201.

Magenta Dye:

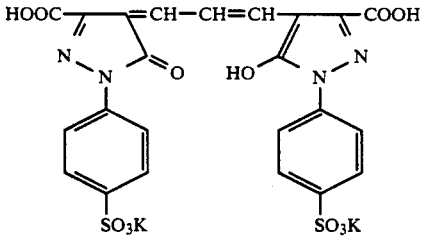

Layer Structure:

Support:

A polyethylene-laminated paper support (the polyethylene layer on the side to be coated with the emulsions contained $TiO_2$ and a trace amount of ultramarine).

| | |
|---|---|
| First Layer (Blue-Sensitive Layer): | |
| Silver Chlorobromide Emulsion | 0.30 g of Ag/m$^2$ |
| Yellow Coupler (Y-1) | 0.82 g/m$^2$ |
| Dye Image Stabilizer (Cpd-7) | 0.09 g/m$^2$ |
| Solvent (Solv-6) | 0.28 ml/m$^2$ |
| Gelatin | 1.75 g/m$^2$ |
| Second Layer (Color Mixing Preventing Layer): | |
| Gelatin | 1.25 g/m$^2$ |
| Color Mixing Inhibitor (Cpd-4) | 0.11 g/m$^2$ |
| Solvent (Solv-2)/(Solv-5) | 0.24/0.26 ml/m$^2$ |
| Third Layer (Green-Sensitive Layer): | |
| Silver Chlorobromide Emulsion | 0.12 g of Ag/m$^2$ |
| Magenta Coupler (M-1) | 0.13 g/m$^2$ |
| Magenta Coupler (M-2) | 0.09 g/m$^2$ |
| Dye Image Stabilizer (Cpd-1) | 0.15 g/m$^2$ |
| Dye Image Stabilizer (Cpd-8) | 0.02 g/m$^2$ |
| Dye Image Stabilizer (Cpd-9) | 0.03 g/m$^2$ |
| Solvent (Solv-1) | 0.34 ml/m$^2$ |
| Solvent (Solv-2) | 0.17 ml/m$^2$ |
| Gelatin | 1.25 g/m$^2$ |
| Fourth Layer (Ultraviolet Absorbing Layer): | |
| Gelatin | 1.58 g/m$^2$ |
| Ultraviolet Absorbent (UV-1) | 0.47 g/m$^2$ |
| Color Mixing Inhibitor (Cpd-4) | 0.05 g/m$^2$ |
| Solvent (Solv-3) | 0.26 ml/m$^2$ |
| Fifth Layer (Red-Sensitive Layer): | |
| Silver Chlorobromide Emulsion | 0.23 g of Ag/m$^2$ |
| Cyan Coupler (C-1) | 0.32 g/m$^2$ |
| Dye Image Stabilizer (Cpd-5) | 0.17 g/m$^2$ |
| Dye Image Stabilizer (Cpd-6) | 0.04 g/m$^2$ |
| Dye Image Stabilizer (Cpd-7) | 0.40 g/m$^2$ |
| Solvent (Solv-4) | 0.15 g/m$^2$ |
| Gelatin | 1.34 g/m$^2$ |
| Sixth Layer (Ultraviolet Absorbing Layer): | |
| Gelatin | 0.53 g/m$^2$ |
| Ultraviolet Absorbent (UV-1) | 0.16 g/m$^2$ |
| Color Mixing Inhibitor (Cpd-4) | 0.02 g/m$^2$ |
| Solvent (Solv-3) | 0.09 ml/m$^2$ |
| Seventh-Layer (Protective Layer): | |
| Gelatin | 1.33 g/m$^2$ |
| Acryl-modified Copolymer of Polyvinyl Alcohol (degree of modification: 17%) | 0.17 g/m$^2$ |
| Liquid Paraffin | 0.03 ml/m$^2$ |

The compounds used in the preparation of Sample 201 were as follows:

Yellow Coupler (Y-1):

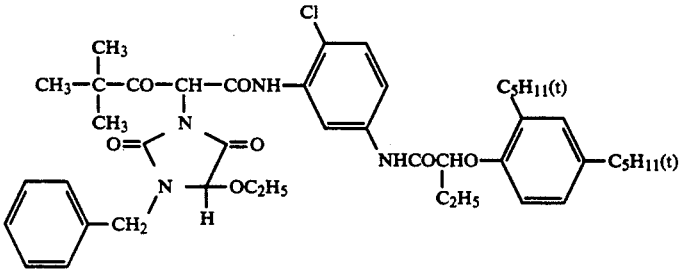

Cyan Coupler (C-1):

A 2:4:4 (by weight) mixture of

-continued
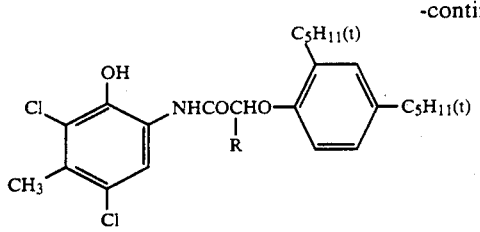
R = $C_2H_5$
Same as above
R = $C_4H_9$ and
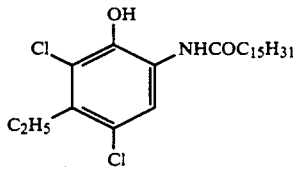
Magenta Coupler (M-1):
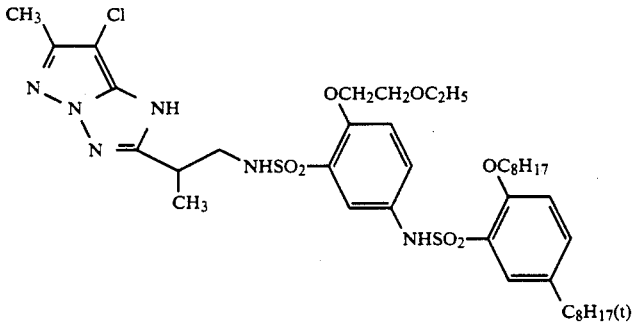
Magenta Coupler (M-2):
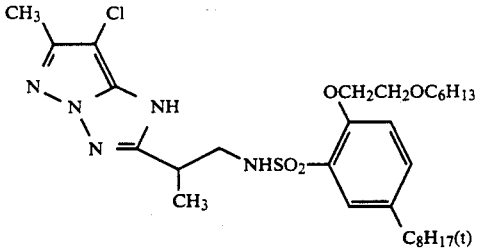
Dye Image Stabilizer (Cpd-1):
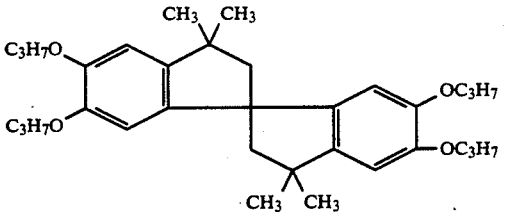
Color Mixing Inhibitor (Cpd-4):
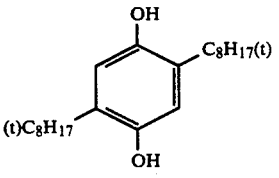

-continued
Dye Image Stabilizer (Cpd-5):
A 2:4:4 (by weight) mixture of
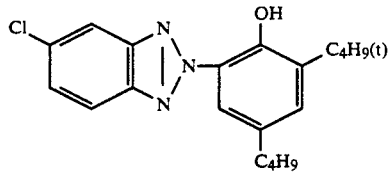
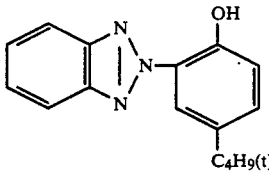
and
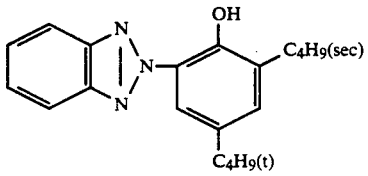
Dye Image Stabilizer (Cpd-6):
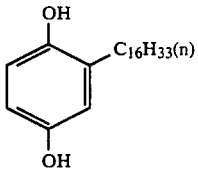
Dye Image Stabilizer (Cpd-7):
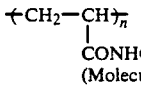
(Molecular weight: about 60,000)
Dye Image Stabilizer (Cpd-8):
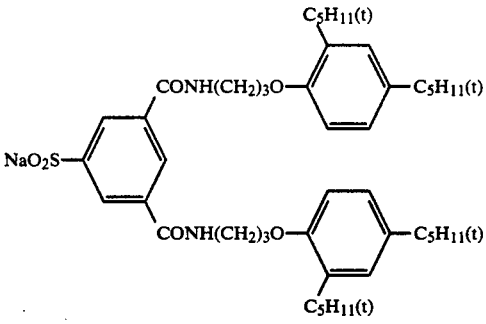
Dye Image Stabilizer (Cpd-9):
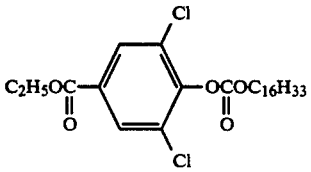
Solvent (Solv-1):
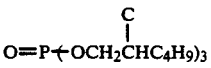

-continued

Solvent (Solv-2):

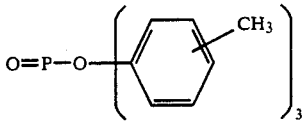

Solvent (Solv-3):

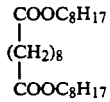

Solvent (Solv-4):

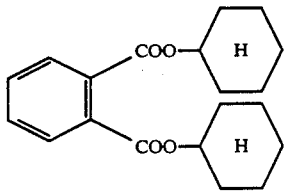

Solvent (Solv-5):

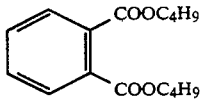

Solvent (Solv-6):

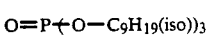

Ultraviolet Absorbent (UV-1):
A 4:2:4 mixture (by weight) mixture of:

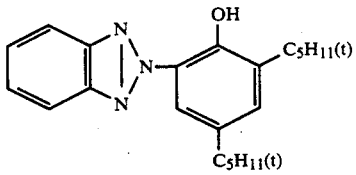

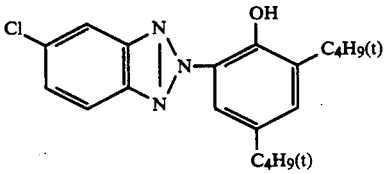

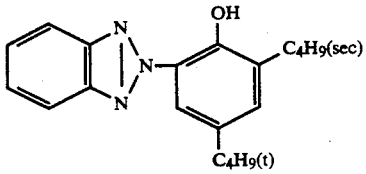

Samples 202 to 205 were prepared in the same manner as Sample 210, except for further adding each of the cyan dyes shown in Table 3 below as an anti-irradiation dye.

TABLE 3

| | Sample No. | | | | |
|---|---|---|---|---|---|
| | 201 | 202 | 203 | 204 | 205 |
| Transmission R Density of Reflective Support | 0.80 | 0.80 | 0.80 | 0.80 | 0.80 |
| Anti-Irradiation Cyan Dye (Amount: mg/m$^2$) | none | A-9 (30.0) | A-13 (15.0) | A-13 (30.0) | C-(a) (30.0) |

Each of Samples 201 to 205 was tested under practical continuous processing. Namely, each sample was imagewise exposed to light using a negative image of scene having a color-forming density corresponding to the average color-forming density of a lot of user prints on the market and continuously processed according to the following procedure using the following processing solutions until the amount of a color developer replenisher supplied reached double the volume of the developer tank.

Processing Procedure:

| Processing Step | Temperature (°C.) | Time (sec) | Rate of Replenishment (ml/m$^2$) | Tank Volume (l) |
|---|---|---|---|---|
| Color Development | 38 | 45 | see Table 4 | 4 |
| Bleach-Fix | 30–36 | 45 | 61 | 4 |
| Washing (1)* | 30–37 | 30 | — | 2 |
| Washing (2)* | 30–37 | 30 | — | 2 |
| Washing (3)* | 30–37 | 30 | 364 | 2 |
| Drying | 70–80 | 60 | | |

Color Developer:

-continued

| [Running Solution] | |
|---|---|
| Water | 800 ml |
| Ethylenediamine-N,N,N',N'-tetramethylenephosphonic Acid | 3.0 g |
| Organic Preservative (VI-19) | 4.5 g |
| Triethanolamine | 8.0 g |
| Sodium Chloride | see Table 4 |
| Potassium Bromide | see Table 4 |
| Potassium Carbonate | 25.0 g |
| N-Ethyl-N-(β-methanesulfonamino-ethyl)-3-methyl-4-aminoaniline Sulfate | 5.0 g |
| Fluorescent Whitening Agent "WHITEX-4" (Produced by Sumitomo chemical Co., Ltd.) | 1.0 g |
| Water to make | 1000 ml |
| pH (25° C.) | 10.05 |

[Replenisher]

| | Replenisher A | Replenisher B | Replenisher C | Replenisher D |
|---|---|---|---|---|
| Composition (g/l): | | | | |
| Ethylenediamine-N,N,N',N'-tetramethylenephosphonic Acid | 3.0 | 3.0 | 3.0 | 3.0 |
| Triethanolamine | 12.0 | 12.0 | 12.0 | 12.0 |
| Sodium Chloride | | see Table 4 | | |
| Potassium Bromide | | see Table 4 | | |
| Potassium Carbonate | 26.0 | 26.0 | 26.0 | 26.0 |
| N-Ethyl-N-(β-methanesulfonamido-ethyl)-3-methyl-4-aminoaniline sulfate | 6.0 | 7.0 | 9.0 | 11.0 |
| Organic Preservative (VI-19) | 6.0 | 6.0 | 7.0 | 9.0 |
| WHITEX-4 | 1.5 | 2.0 | 2.5 | 3.0 |
| pH (25° C.), adjusted with KOH or $H_2SO_4$ | 10.35 | 10.45 | 10.55 | 10.65 |

Bleach-Fix Solution:

| [Running Solution] | |
|---|---|
| Water | 400 ml |
| Ammonium Thiosulfate (55% aq. soln.) | 100 ml |
| Ammonium Sulfite | 38.0 g |
| Ammonium (Ethylenediaminetetraacetato)-iron (III) | 55.0 g |
| Disodium Ethylenediaminetetraacetate | 5.0 g |
| Ammonium Bromide | 40.0 g |
| Glacial Acetic Acid | 9.0 g |
| Water to make | 1000 ml |
| pH (25° C.) | 5.80 |

[Replenisher]

A 2.5-fold concentrate of the running solution.

Note: *Washing was effected in a counter flow manner of from (3) toward (1). The washing water (1) was introduced into the bleach-fix bath at a rate of replenishment of 122 ml/m².

Washing Solution:

Running Solution = Replenisher

Ion-exchanged water containing not more than 3 ppm of each of calcium and magnesium.

During continuous processing, each of the color developer, bleach-fix solution, and washing solution was replenished with distilled water in an amount corresponding to the evaporation loss.

The variations of the photographic characteristics arising during the continuous processing were examined as follows. The sample was sensitometrically exposed to light in the same manner as in Example 1 using each of blue, green and red filters and subjected to color development processing using the processing system at the start and at the end of the continuous processing. The fog, relative sensitivity (the sensitivity of Sample 204 of Run No. 22 being taken as 100) and maximum color density for each color was determined for each of the thus processed samples.

Further, at the start of the continuous processing, each of the samples was evaluated as to sensitivity reduction when exposed under a high humidity condition and for sharpness in the same manner as in Example 1.

The results obtained are shown in Table 4 below.

TABLE 4

| | Run No. | | | | | | |
|---|---|---|---|---|---|---|---|
| | 21 | 22 | 23 | 24 | 25 | 26 | 27 |
| Sample No. | 204 | 204 | 204 | 204 | 204 | 204 | 204 |
| Replenisher | A | C | C | C | D | A | B |
| Rate of Replenishment (ml/m2) | 300 | 100 | 100 | 100 | 100 | 300 | 200 |
| Ion Concentration in Developer (mol/l) | | | | | | | |
| $Cl^-$: | | | | | | | |
| Running Solution | $1.4 \times 10^{-2}$ | $4.3 \times 10^{-2}$ | $5.0 \times 10^{-2}$ | $1.5 \times 10^{-1}$ | $4.3 \times 10^{-2}$ | $3.6 \times 10^{-2}$ | $6.0 \times 10^{-2}$ |
| Replenisher | — | — | $0.7 \times 10^{-2}$ | $1.0 \times 10^{-2}$ | — | $2.2 \times 10^{-2}$ | $4.0 \times 10^{-2}$ |
| $Br^-$: | | | | | | | |
| Running Solution | $2.0 \times 10^{-5}$ | $1.2 \times 10^{-4}$ | $5 \times 10^{-4}$ | $1.0 \times 10^{-3}$ | $1.7 \times 10^{-3}$ | $4.0 \times 10^{-5}$ | $2.0 \times 10^{-4}$ |
| Replenisher | — | — | $3.8 \times 10^{-4}$ | $9.0 \times 10^{-4}$ | $1.6 \times 10^{-3}$ | $2.0 \times 10^{-5}$ | $1.4 \times 10^{-4}$ |
| At the Start of Continuous Processing: | | | | | | | |
| Fog: | | | | | | | |
| B | 0.11 | 0.10 | 0.09 | 0.08 | 0.07 | 0.10 | 0.09 |
| G | 0.10 | 0.09 | 0.08 | 0.09 | 0.08 | 0.09 | 0.09 |
| R | 0.11 | 0.10 | 0.09 | 0.09 | 0.08 | 0.10 | 0.09 |
| Relative Sensitivity: | | | | | | | |
| B | 106 | 100 | 98 | 96 | 77 | 102 | 99 |
| G | 104 | 100 | 99 | 97 | 75 | 103 | 98 |
| R | 108 | 100 | 96 | 95 | 71 | 106 | 98 |
| Maximum Density: | | | | | | | |
| B | 2.31 | 2.30 | 2.27 | 2.27 | 2.18 | 2.31 | 2.29 |
| G | 2.52 | 2.51 | 2.48 | 2.47 | 2.36 | 2.51 | 2.47 |
| R | 2.73 | 2.64 | 2.60 | 2.58 | 2.49 | 2.71 | 2.58 |
| At the End of Continuous Processing: | | | | | | | |
| Fog: | | | | | | | |
| B | 0.20 | 0.11 | 0.10 | 0.10 | 0.08 | 0.09 | 0.10 |
| G | 0.13 | 0.11 | 0.10 | 0.11 | 0.09 | 0.11 | 0.11 |
| R | 0.15 | 0.12 | 0.11 | 0.12 | 0.10 | 0.12 | 0.12 |

TABLE 4-continued

| | | | | | | | |
|---|---|---|---|---|---|---|---|
| Relative Sensitivity: | | | | | | | |
| B | 81 | 95 | 93 | 92 | 71 | 97 | 94 |
| G | 87 | 93 | 94 | 93 | 69 | 94 | 95 |
| R | 83 | 92 | 91 | 91 | 54 | 95 | 94 |
| Maximum Density: | | | | | | | |
| B | 2.27 | 2.29 | 2.26 | 2.26 | 2.09 | 2.30 | 2.27 |
| G | 2.46 | 2.48 | 2.45 | 2.44 | 2.27 | 2.47 | 2.45 |
| R | 2.64 | 2.61 | 2.59 | 2.57 | 2.38 | 2.68 | 2.57 |
| Sensitivity Decrease on Exposure at High Humidity: | | | | | | | |
| B | −6 | −5 | −6 | −7 | −5 | −5 | −8 |
| G | +3 | +4 | +5 | +3 | +5 | +4 | +3 |
| R | +6 | +7 | +5 | +8 | +7 | +7 | +8 |
| CTF Value of Cyan Dye Image (6 c/mm) | 0.77 | 0.78 | 0.79 | 0.77 | 0.78 | 0.79 | 0.80 |
| Remark | Comparison | Invention | Invention | Invention | Comparison | Invention | Invention |

| | Run No. | | | | | |
|---|---|---|---|---|---|---|
| | 28 | 29 | 30 | 31 | 32 | 33 |
| Sample No. | 204 | 201 | 201 | 202 | 203 | 205 |
| Replenisher | D | A | C | C | C | C |
| Rate of Replenishment (ml/m2) | 30 | 300 | 100 | 100 | 100 | 100 |
| Ion Concentration in Developer (mol/l) | | | | | | |
| $Cl^-$: | | | | | | |
| Running Solution | $1.2 \times 10^{-1}$ | $1.4 \times 10^{-2}$ | $4.3 \times 10^{-2}$ | $4.3 \times 10^{-2}$ | $4.3 \times 10^{-2}$ | $4.3 \times 10^{-2}$ |
| Replenisher | — | — | — | — | — | — |
| $Br^-$: | | | | | | |
| Running Solution | $7.0 \times 10^{-4}$ | $2.0 \times 10^{-5}$ | $1.2 \times 10^{-4}$ | $1.2 \times 10^{-4}$ | $1.2 \times 10^{-4}$ | $1.2 \times 10^{-4}$ |
| Replenisher | $3.5 \times 10^{-4}$ | — | — | — | — | — |
| At the Start of Continuous Processing: | | | | | | |
| Fog: | | | | | | |
| B | 0.07 | 0.10 | 0.09 | 0.10 | 0.08 | 0.11 |
| G | 0.08 | 0.09 | 0.08 | 0.09 | 0.09 | 0.09 |
| R | 0.09 | 0.07 | 0.07 | 0.11 | 0.09 | 0.10 |
| Relative Sensitivity: | | | | | | |
| B | 97 | 164 | 153 | 97 | 110 | 85 |
| G | 98 | 148 | 137 | 98 | 124 | 91 |
| R | 96 | 267 | 249 | 91 | 149 | 94 |
| Maximum Density: | | | | | | |
| B | 2.28 | 2.33 | 2.30 | 2.28 | 2.29 | 2.27 |
| G | 2.46 | 2.54 | 2.51 | 2.46 | 2.48 | 2.45 |
| R | 2.58 | 2.75 | 2.72 | 2.61 | 2.68 | 2.60 |
| At the End of Continuous Processing: | | | | | | |
| Fog: | | | | | | |
| B | 0.09 | 0.12 | 0.10 | 0.12 | 0.10 | 0.22 |
| G | 0.10 | 0.10 | 0.09 | 0.11 | 0.11 | 0.14 |
| R | 0.11 | 0.09 | 0.09 | 0.13 | 0.12 | 0.19 |
| Relative Sensitivity: | | | | | | |
| B | 92 | 151 | 149 | 91 | 107 | 68 |
| G | 93 | 135 | 132 | 93 | 120 | 75 |
| R | 92 | 144 | 241 | 88 | 146 | 84 |
| Maximum Density: | | | | | | |
| B | 2.26 | 2.27 | 2.26 | 2.23 | 2.30 | 2.14 |
| G | 2.44 | 2.49 | 2.48 | 2.42 | 2.49 | 2.41 |
| R | 2.55 | 2.68 | 2.66 | 2.57 | 2.63 | 2.52 |
| Sensitivity Decrease on Exposure at High Humidity: | | | | | | |
| B | −7 | −6 | −5 | −6 | −7 | −48 |
| G | +4 | +3 | +4 | +5 | +3 | −4 |
| R | +6 | +6 | +7 | +5 | +8 | +1 |
| CTF Value of Cyan Dye Image (6 c/mm) | 0.78 | 0.52 | 0.53 | 0.84 | 0.72 | 0.78 |
| Remark | Invention | Comparison | Comparison | Invention | Invention | Comparison |

As is apparent from the results in Table 4, the present invention makes it possible to significantly improve image sharpness without causing an increase of fog through continuous processing or a decrease in sensitivity when exposure is carried our under high humidity conditions. It is surprising that the image formation system of the present invention is substantially equal to the system using no anti-irradiation dye in terms of stability in continuous processing and independence of the effects of humidity at the time of exposure (i.e., reduction in sensitivity by exposure under high humidity conditions).

As demonstrated in the foregoing Examples, the present invention provides a system permitting rapid and stable production of color prints of high quality by using a silver halide color photographic material which exhibits high sensitivity and can be subjected to rapid processing and also exhibits excellent sharpness even if the reflective support thereof has a low transmission density. The present invention also makes it possible to prevent desensitization at the time of exposure under high humidity conditions. The present invention further achieves favorable reproduction of gradation without impairing the linearity of photographic response.

While the invention has been described in detail and with reference to specific embodiments thereof, it will be apparent to one skilled in the art that various changes and modifications can be made therein without departing from the spirit and scope thereof.

What is claimed is:

1. A method for forming a color image which comprises developing an imagewise exposed silver halide color photographic material with a color developer containing at least one aromatic primary amine developing agent, wherein said silver halide color photographic material comprises a reflective support whose transmission density in the red region is from 0.2 to 0.9, having thereon at least one light-sensitive emulsion layer containing at least one coupler of forming a dye on coupling with an oxidation product of said developing agent and silver chlorobromide grains comprising 98 to 99.9 mol % of silver chloride and containing substantially no silver iodide, said support having further provided thereon a dye represented by formula (A):

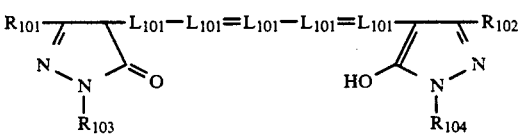

(A)

wherein $R_{101}$ and $R_{102}$ each represents $-OR_{105}$, $-COOR_{105}$, $$-\underset{\underset{R_{106}}{|}}{CON}-R_{105},$$

$-COR_{105}$, $-CN$ or $-R_{107}$, wherein $R_{105}$ and $R_{106}$ each represents a hydrogen atom, a substituted or unsubstituted alkyl group or a substituted or unsubstituted aryl group, and $R_{107}$ represents an alkyl group or an alkyl group substituted with a halogen atom, a carboxyl group, a sulfo group or a hydroxy group; $R_{103}$ and $R_{104}$ each represents an alkyl, aralkyl or aryl group substituted with at least one of a sulfo group or a carboxyl group; and $L_{101}$ represents a substituted or unsubstituted methine group, and said color developer contains from $3.5\times10^{-2}$ to $1.5\times10^{-1}$ mol/l of chloride ion and from $5.0\times10^{-5}$ to $5.0\times10^{-4}$ mol/l of bromide ion.

2. A method as claimed in claim 1, wherein said dye represented by formula (A) is present in an amount of from about 0.1 to 500 mg per $m^2$ of the silver halide color photographic material.

3. A method as claimed in claim 1, wherein said dye represented by formula (A) is presenting an amount of from 5.0 to 100 mg per $m^2$ of the silver halide color photographic material.

4. A method as claimed in claim 1, wherein said reflective support has a transmission density of 0.88 or less in the red region.

5. A method as claimed in claim 1, wherein said reflective support has a transmission density of 0.86 or less in the red region.

6. A method as claimed in claim 1, wherein said developer contains from $4.0\times10^{-2}$ to $1.0\times10^{-1}$ mol/l of chloride ion.

7. A method as claimed in claim 1, wherein the silver halide color photographic material contains a yellow coupler, a magenta coupler and a cyan coupler.

8. A method as claimed in claim 1, wherein the silver chlorobromide grains contain not more than 1 mol % silver iodide.

9. A method as claimed in claim 1, wherein the silver chlorobromide grains contain not more than 0.2 mol % silver iodide.

10. A method as claimed in claim 1, wherein the silver chlorobromide grains comprise monodispersed silver chlorobromide grains having a coefficient of variation of grain size of not more than 20%.

11. A method as claimed in claim 1, wherein said color developer contains not more than 2.0 ml/l of benzyl alcohol.

12. A method as claimed in claim 1, wherein said color developer does not contain any benzyl alcohol at all.

* * * * *